US010783827B2

(12) United States Patent
Shin et al.

(10) Patent No.: US 10,783,827 B2
(45) Date of Patent: Sep. 22, 2020

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Jeong Hwan Shin, Yongin-si (KR); Sung Hoon Bang, Yongin-si (KR); Sang Jae Yeo, Yongin-si (KR); Oh Jo Kwon, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 168 days.

(21) Appl. No.: 15/699,162

(22) Filed: Sep. 8, 2017

(65) Prior Publication Data

US 2018/0082639 A1 Mar. 22, 2018

(30) Foreign Application Priority Data

Sep. 22, 2016 (KR) ..... 10-2016-0121321

(51) Int. Cl.

| | |
|---|---|
| ***G09G 3/3258*** | (2016.01) |
| ***G09G 3/3216*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3216* (2013.01); *G09G 3/3266* (2013.01); *G09G 3/3275* (2013.01); *G09G 2300/0819* (2013.01); *G09G 2310/08* (2013.01); *G09G 2320/0223* (2013.01); *G09G 2320/0295* (2013.01); *G09G 2320/043* (2013.01); *G09G 2320/045* (2013.01); *G09G 2320/0693* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 2006/0060752 | A1* | 3/2006 | Lee | G06F 3/042 250/208.1 |
| 2011/0084955 | A1 | 4/2011 | Kim | |
| 2013/0050292 | A1* | 2/2013 | Mizukoshi | G09G 3/3291 345/690 |
| 2013/0162617 | A1* | 6/2013 | Yoon | G09G 3/3233 345/211 |

(Continued)

FOREIGN PATENT DOCUMENTS

KR 1020150055786 A 5/2015

OTHER PUBLICATIONS

Extended European Search Report for Application No. 17192736.1 dated May 4, 2018.

(Continued)

*Primary Examiner* — Parul H Gupta

(74) *Attorney, Agent, or Firm* — Cantor Colburn LLP

(57) ABSTRACT

A display device includes pixels connected to data lines and scan lines, a first compensator which is connected to sensing lines and senses deviation information of the sensing lines while supplying different voltages to adjacent sensing lines, and a sensing unit which is connected to the first compensator and senses characteristic information of each of the pixels.

34 Claims, 14 Drawing Sheets

(56) References Cited

U.S. PATENT DOCUMENTS

| | | | | |
|---|---|---|---|---|
| 2013/0314394 | A1* | 11/2013 | Chaji | G09G 3/18 345/212 |
| 2015/0130780 | A1 | 5/2015 | Kwon et al. | |
| 2016/0086539 | A1 | 3/2016 | Mizukoshi | |

OTHER PUBLICATIONS

Hal Philipp, Charge transfer sensing, 1999, pp. 96-105, vol. 19, No. 2, Sensor Review, IFS Publications, Bedford, GB.

European Search Report for Application No. 17192736.1 dated Jan. 5, 2018.

* cited by examiner

DISPLAY DEVICE AND DRIVING METHOD THEREOF

This application claims priority to Korean Patent Application No. 10-2016-0121321, filed on Sep. 22, 2016, and all the benefits accruing therefrom under 35 U.S.C. § 119, the content of which in its entirety is herein incorporated by reference.

BACKGROUND

1. Field

Exemplary embodiments of the invention relate to a display device and a driving method thereof, and more particularly, to a display device which improves image quality and a driving method thereof.

2. Description of the Related Art

With a development of information technology, a display device as a connection medium between a user and information has been in high demand. In response, display devices such as a liquid crystal display device, an organic light emitting display device, etc., have been increasingly used.

An organic light emitting display device among the display devices displays an image by pixels connected to a plurality of scan lines and data lines. To this end, each of the pixels includes an organic light emitting diode and a driving transistor.

The driving transistor controls an amount of current supplied to the organic light emitting diode corresponding to a data signal supplied from a data line of the plurality of data lines. The organic light emitting diode emits light of a predetermined brightness corresponding to the amount of current supplied from the driving transistor.

The driving transistor included in each of the pixels supplies a uniform current to the organic light emitting diode corresponding to the data signal, so that the display device displays a uniform quality of image. However, the driving transistor included in each of the pixels has a characteristic value including deviation.

An external compensation method for compensating for such a characteristic deviation of the pixels from an external source has been proposed. In the external compensation method, mobility and threshold voltage information of the driving transistor included in each of the pixels are sensed, and the data signal supplied to each of the pixels according to the sensed information is controlled, for example.

SUMMARY

An external compensation method may not accurately detect characteristic deviations of pixels due to a deviation of each channel of a corresponding driving transistor, and therefore there is a limit in compensating the image quality accordingly.

Therefore, the invention provides a display device and a driving method thereof to improve image quality by accurately sensing a characteristic deviation of pixels regardless of a channel deviation.

According to an exemplary embodiment of the invention, there is provided a display device including pixels connected to data lines and scan lines, a first compensator which is connected to sensing lines and senses deviation information of the sensing lines while supplying different voltages to adjacent sensing lines of the sensing lines, and a sensing unit which is connected to the first compensator and senses characteristic information of each of the pixels.

In an exemplary embodiment, the first compensator may supply a first voltage to a first capacitor provided in a predetermined sensing line of the adjacent sensing lines and supplies a second voltage different from the first voltage to a second capacitor provided in an adjacent sensing line of the adjacent sensing lines.

In an exemplary embodiment, the sensing unit may generate first channel data in a digital form by a voltage stored in the first capacitor and generate second channel data in a digital form by a voltage stored in the second capacitor.

In an exemplary embodiment, the sensing unit may generate charge data in a digital form by a charge share voltage generated by charge-sharing the first capacitor and the second capacitor.

In an exemplary embodiment, the display device may further include a timing controller which obtains a ratio of the first capacitor to the second capacitor by the first channel data, the second channel data, and the charge data, where the ratio of the first capacitor to the second capacitor is the deviation information.

In an exemplary embodiment, the first compensator may include a multiplexer connected to the sensing lines and a switch unit connected between the multiplexer and the sensing unit.

In an exemplary embodiment, the switch unit may include a first switch connected between the multiplexer and a first node, a second switch connected between the multiplexer and the first node, a third switch connected between the first node and a reference power supply, and a fourth switch connected between the first node and the sensing unit.

In an exemplary embodiment, the multiplexer may sequentially connect the first switch to a first sensing line to an (m−1)th sensing line of the sensing lines where m is a natural number greater than two, and sequentially connect the second switch to a second sensing line to an mth sensing line of the sensing lines.

In an exemplary embodiment, the third switch may be turned on to supply a first voltage of the reference power supply to a predetermined sensing line of the adjacent sensing lines connected to the first switch during at least a portion of a period in which the first switch is turned on, and the third switch may be turned on to supply a second voltage of the reference power supply to an adjacent sensing line of the adjacent sensing lines connected to the second switch during at least a portion of a period in which the second switch is turned on In an exemplary embodiment, the first voltage and the second voltage may be set to different values.

In an exemplary embodiment, the first voltage may be set to be higher than the second voltage.

In an exemplary embodiment, after the first voltage is stored in a first capacitor equivalently provided in the predetermined sensing line, and the second voltage is stored in a second capacitor equivalently provided in the adjacent sensing line, the first switch and the second switch may be turned on, and voltages respectively stored in the first capacitor and the second capacitor may be charge-shared.

In an exemplary embodiment, a ratio of the first capacitor to the second capacitor may be the deviation information.

In an exemplary embodiment, the first compensator may include a first switch unit connected to the sensing lines, a multiplexer connected to the first switch, and a second switch unit connected between the multiplexer and the sensing unit.

In an exemplary embodiment, the first switch unit may include first switches connected between the sensing lines and the multiplexer, second switches connected between odd-numbered sensing lines of the sensing lines and a reference power supply, and third switches connected between even-numbered sensing lines and the reference power supply.

In an exemplary embodiment, the reference power supply may be set to a first voltage when the second switches are turned on, and the reference power supply may be set to a second voltage different from the first voltage when the third switches are turned on.

In an exemplary embodiment, the second switches and the third switches may be turned on at different times from each other.

In an exemplary embodiment, the display device may further include an auxiliary capacitor disposed between a first switch of the first switches and the multiplexer and connected between the first switch and a ground power supply.

In an exemplary embodiment, the second switch unit may include a fourth switch connected between the multiplexer and the sensing unit, and a fifth switch connected between the multiplexer and the sensing unit.

In an exemplary embodiment, the multiplexer may sequentially connect the fourth switch to the odd numbered sensing lines, and the multiplexer may sequentially connect the fifth switch to the even numbered sensing lines.

In an exemplary embodiment, the first switch unit may include first switches connected between the sensing lines and the multiplexer, second switches connected between odd-numbered sensing lines of the sensing lines and a first reference power supply, and third switches connected between even numbered sensing lines of the sensing lines and a second reference power supply.

In an exemplary embodiment, the first reference power supply may be set to a first voltage, and the second reference power supply may be set to a second voltage different from the first voltage.

In an exemplary embodiment, the second switches and the third switches may be concurrently turned on and turned off.

In an exemplary embodiment, the first compensator may include a switch unit connected to the sensing lines, and a multiplexer connected between the switch unit and the sensing unit.

In an exemplary embodiment, the switch unit may include first switches connected between the sensing lines and the multiplexer, second switches connected between odd numbered sensing lines of the sensing lines and a first reference power supply, third switches connected between even numbered sensing lines of the sensing lines and a second reference power supply, fourth switches connected between an ith sensing line (where i is an odd number equal to and greater than 1, i.e., i is 1, 3, 5, 7 . . . ) and an (i+1)th sensing line, and fifth switches connected between the (i+1)th sensing line and an (i+2)th sensing line.

In an exemplary embodiment, the first reference power supply may be set to a first voltage and the second reference power supply may be set to a second voltage different from the first voltage.

In an exemplary embodiment, the second switches and the third switches may be concurrently turned on.

In an exemplary embodiment, after a voltage of the first reference power supply is stored in the odd numbered sensing lines and a voltage of the second reference power supply is stored in the even numbered sensing lines, the fourth switches and the first switches may be turned on, and after the voltage of the first reference power supply is stored in the odd numbered sensing lines and the voltage of the second reference power supply is stored in the even numbered sensing lines, the fifth switches and the first switches may be turned on.

In an exemplary embodiment, the display device may further include an auxiliary capacitor disposed between a first switch of the first switches and the multiplexer and connected between the first switch and a ground power supply.

In an exemplary embodiment, the display device may further include a timing controller which removes a deviation of the sensing lines from the characteristic information of each of the pixels by the deviation information.

In an exemplary embodiment, the display device may further includes a scan driver which supplies scan signals to the scan lines, and a data driver which generates data signals by second data and supplies the data signals to the data lines, where the timing controller generates the second data by first data supplied from an external source corresponding to the characteristic information from which the deviation is removed.

In an exemplary embodiment, the sensing lines may be the data lines.

In an exemplary embodiment, the sensing unit may include an analog-to-digital converter which converts the deviation information into first sensing data in a digital form and converts the characteristic information into second sensing data in a digital form, and a second compensator in which the first sensing data and the second sensing data are stored.

In an exemplary embodiment, a display device may include a first sensing line and a second sensing line connected to different pixels, respectively, a first switch disposed between the first sensing line and a first node, a second switch disposed between the second sensing line and the first node, and a timing controller which controls the first switch and the second switch.

In an exemplary embodiment, the display device may further include a third switch connected between the first node and a reference power supply.

In an exemplary embodiment, when the third switch and the first switch are turned on, the reference power supply may be set to a first voltage, and when the third switch and the second switch are turned on, the reference power supply may be set to a second voltage different from the first voltage.

In an exemplary embodiment, the display device may further includes a fourth switch connected to the first node, and an analog-to-digital converter connected to the fourth switch and converting at least one of a voltage applied to the first sensing line and a voltage applied to the second sensing line into digital data.

In an exemplary embodiment, the display device may further include a compensator which obtains a ratio of a first capacitor of the first sensing line to a second capacitor of the second sensing line by the digital data.

In an exemplary embodiment, a driving method of a display device, the method includes sensing deviation information of a first sensing line and a second sensing line while supplying different voltages to the first sensing line and the second sensing line, respectively, sensing characteristic information of pixels connected to the first sensing line and the second sensing line, and removing a deviation of the first and second sensing lines from the characteristic information by the deviation information.

In an exemplary embodiment, the sensing of the deviation information may include supplying a first voltage to the first sensing line, supplying a second voltage different from the first voltage to the second sensing line, generating first channel data in a digital form by a voltage stored in a first capacitor equivalently provided in the first sensing line corresponding to the first voltage, generating second channel data in a digital form by a voltage stored in a second capacitor equivalently provided in the second sensing line corresponding to the second voltage, charge sharing the first capacitor and the second capacitor, and generating charge data in a digital provided by a charge share voltage generated by the charge sharing.

In an exemplary embodiment, the method may further include obtaining a ratio of the first capacitor to the second capacitor by the first channel data, the second channel data and the charge data.

In an exemplary embodiment, the ratio of the first capacitor to the second capacitor may be the deviation information of the first sensing line and the second sensing line.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
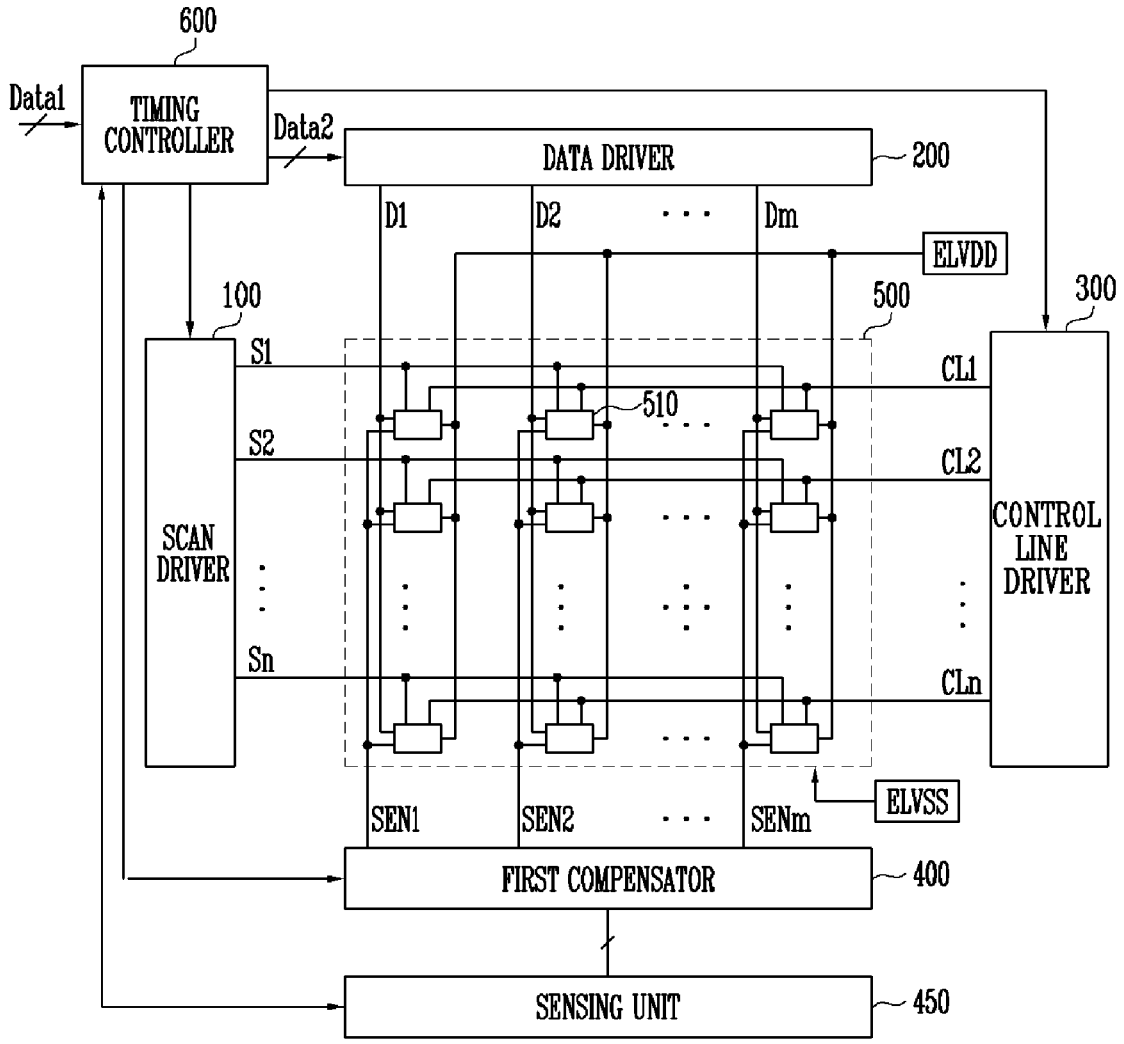
FIG. 1 is a diagram illustrating an exemplary embodiment of a display device according to the invention.

Hereinafter, embodiments of the invention will be described in detail with reference to the accompanying drawings, and the details necessary for those skilled in the art to understand the contents of the invention will be described in detail. However, the invention may be embodied in many different forms within the scope of the appended claims, so that the exemplary embodiments described below are exemplary only, regardless of whether they are expressed or not.

That is, the invention is not limited to the exemplary embodiments described below, but may be embodied in various forms. In the following description, when a portion is connected to another portion, it means they are electrically connected to each other with another element interposed therebetween. It is to be noted that, in the drawings, the same constituent elements are denoted by the same reference numerals and number as possible even though they are shown in different drawings.

The invention now will be described more fully hereinafter with reference to the accompanying drawings, in which various embodiments are shown. This invention may, however, be embodied in many different forms, and should not be construed as limited to the exemplary embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath"

other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a diagram illustrating a display device according to an exemplary embodiment of the invention. In FIG. 1, for convenience of explanation, an exemplary embodiment of the invention will be described on the assumption that the display device is an organic light emitting display device. However, the display device of the invention is not limited to the organic light emitting display device.

Referring to FIG. 1, a display device according to an exemplary embodiment of the invention may include a scan driver 100, a data driver 200, a control line driver 300, a first compensator 400, a sensing unit 450, a pixel unit 500, and a timing controller 600.

The scan driver 100 may supply scan signals to scan lines S1 to Sn corresponding to a control of the timing controller 600. In an exemplary embodiment, the scan driver 100 may sequentially supply the scan signals to the scan lines S1 to Sn, for example. When the scan signals are sequentially supplied to the scan lines S1 to Sn, pixels 510 may be selected on a horizontal line basis. To this end, the scan signal may be set to a gate-on voltage at which transistors included in the pixels 510 may be turned on.

The data driver 200 may generate a data signal corresponding to second data Data2 supplied from the timing controller 600. The data driver 200 that generates the data signal may supply the data signals to data lines D1 to Dm. The data signals supplied to the data lines D1 to Dm may be supplied to the pixels 510 selected by the scan signals. The pixels 510 may emit light of a predetermined brightness corresponding to the data signals, and accordingly a predetermined image may be displayed in the pixel unit 500.

The second data Data2 described above may be a value based on first data Data1 input from an external source corresponding to the image to be displayed on the pixel unit 500, and may be set to a value obtained by changing the first data Data1 so that deviation of a driving transistor included in each of the pixels 510 may be compensated.

The control line driver 300 may supply control signals to control lines CL1 to CLn in response to control of the timing controller 600. In an exemplary embodiment, during a period in which characteristic information of each of the pixels 510 is sensed, for example, during a sensing period, the control line driver 300 may sequentially supply the control signals to the control lines CL1 to CLn, for example. According to an exemplary embodiment, the control signal may be set to a gate-on voltage by which transistors included in the pixels 510 may be turned on. In such a case, the pixels 510 supplied with the control signals may be electrically connected to sensing lines SEN1 to SENm.

The control line driver 300 may not necessarily be provided in the exemplary embodiment of the invention. In an exemplary embodiment, the scan driver 100 may supply the control signals to the control lines CL1 to CLn in replacement of the control line driver 300, for example. In an exemplary embodiment, instead of forming separate control lines CL1 to CLn, the electrical connections between the pixels 510 and the sensing lines SEN1 to SENm may be controlled by the scan lines S1 to Sn during the sensing period.

The first compensator 400 may be connected to the sensing lines SEN1 to SENm. The first compensator 400 may sense deviation information (i.e., channel deviation information) of each of the sensing lines SEN1 to SENm. In an exemplary embodiment, the first compensator 400 may sense a capacitance of a parasitic capacitor provided in each of the sensing lines SEN1 to SENm as the channel deviation information. A detailed description thereof will be given below, for example.

In FIG. 1, the first compensator 400 is connected to the sensing lines SEN1 to SENm, but the invention is not limited thereto. In an exemplary embodiment, the invention may be applied to various types of external compensation methods which are known in the art, and the first compensator 400 may be connected to the data lines D1 to Dm, for example. In such a case, the first compensator 400 may sense a capacitance of a parasitic capacitor of each of the data lines D1 to Dm as the channel deviation information.

The sensing unit 450 may sense characteristic information of each of the pixels 510. In an exemplary embodiment, the sensing unit 450 may sense threshold voltage information, mobility information of the driving transistor included in each of the pixels 510, and/or deterioration information of the organic light emitting diode as the characteristic information of each of the pixels 510, for example.

The sensing unit 450 may convert deviation information of the channel sensed in the first compensator 400 into first sensing data in a digital form and the characteristic information of the pixels 510 into second sensing data in a digital form to output the first sensing data and the second sensing data. To this end, the sensing unit 450 may include an analog-to-digital converter ("ADC") (not shown). The first sensing data and the second sensing data output from the sensing unit 450 may be stored in a memory which is not shown.

The first sensing data and the second sensing data stored in the memory may be used to convert the first data Data1 into the second data Data2 so that the characteristic deviations of the pixels 510 may be compensated. In an exemplary embodiment, the timing controller 600 may remove the channel deviation from the second sensing data by the first sensing data and generate the second data Data2 by the second sensing data from which the channel deviation is removed, for example. Thus, the characteristic deviations of the pixels 510 may be accurately compensated regardless of the channel deviation.

The pixel unit 500 may include the pixels 510 arranged to be connected to the scan lines S1 to Sn, the control lines CL1 to CLn, the sensing lines SEN1 to SENm, and the data lines D1 to Dm. In such a case, the pixel unit 500 may be set as a display area for displaying a predetermined image. Each of the pixels 510 may be electrically connected to a first driving power supply ELVDD and a second driving power supply ELVSS. The first driving power supply ELVDD may be set to a voltage higher than the second driving power supply ELVSS.

Each of the pixels 510 may include the driving transistor and the organic light emitting diode. The driving transistor may control the amount of current flowing from the first driving power supply ELVDD to the second driving power supply ELVSS via the organic light emitting diode corresponding to the data signal. The organic light emitting diode may emit light of a brightness corresponding to the amount of current supplied from the driving transistor. However, when a data signal corresponding to a black grayscale is supplied, the driving transistor may control the current not to flow to the organic light emitting diode, so that the organic light emitting diode may be set in a non-light emitting state.

The timing controller 600 may control the scan driver 100, the data driver 200, the first compensator 400, and the sensing unit 450. In addition, the timing controller 600 may generate the second data Data2 by changing bits of the first data Data1 corresponding to the first sensing data and the second sensing data.

FIG. 1 shows only the configuration desired for explanation of the invention, and various configurations may be added to an actual display device. In an exemplary embodiment, one or more dummy scan lines may be additionally included for driving stability, for example. In addition, the scan driver 100, the data driver 200, the first compensator 400, the sensing unit 450 and/or the timing controller 600 may be disposed (e.g., mounted) on a panel (not shown) together with the pixel unit 500.

Figure 2A:
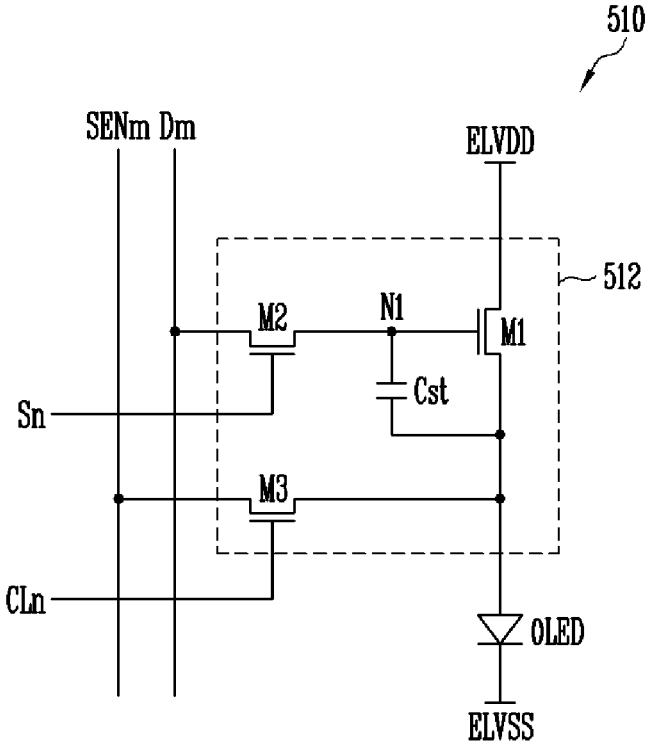
FIGS. 2A and 2B are diagrams illustrating exemplary embodiments of a pixel shown in FIG. 1.
Figure 2B:
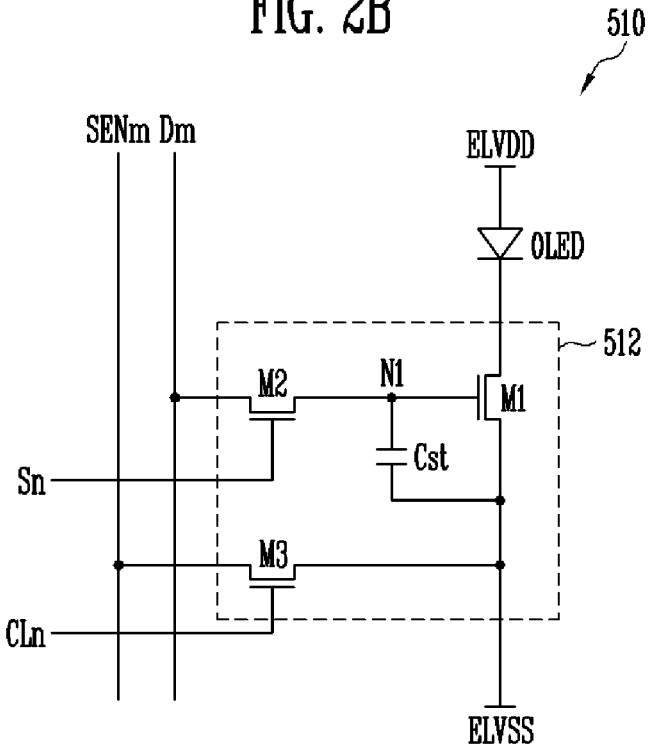

FIGS. 2A and 2B are diagrams illustrating an exemplary embodiment of a pixel shown in FIG. 1 In FIG. 2A, a pixel connected to an mth data line Dm and an nth scan line Sn are shown for convenience of explanation.

Referring to FIG. 2A, the pixel 510 according to an exemplary embodiment of the invention may include an organic light emitting diode OLED and a pixel circuit 512.

An anode electrode of the organic light emitting diode OLED may be connected to the pixel circuit 512, and a cathode electrode may be connected to the second driving power supply ELVSS. The organic light emitting diode OLED may emit light of a brightness corresponding to the amount of current supplied from the pixel circuit 512.

The pixel circuit 512 may control the amount of current flowing from the first driving power supply ELVDD to the second driving power data driver supply ELVSS via the organic light emitting diode OLED corresponding to the data signal. To this end, the pixel circuit 512 may include a first transistor M1, a second transistor M2, a third transistor M3, and a storage capacitor Cst.

In an exemplary embodiment, at least one of the first to third transistors M1 to M3 may be an oxide semiconductor thin film transistor ("TFT") including an active layer including an oxide semiconductor, for example. In an exemplary embodiment, at least one of the first to third transistors M1 to M3 may be a low-temperature polycrystalline silicon ("LTPS") TFT including an active layer including polysilicon, for example.

A first electrode of the first transistor M1 may be connected to the first driving power supply ELVDD and a second electrode of the first transistor M1 may be connected to the anode electrode of the organic light emitting diode OLED. A gate electrode of the first transistor M1 may be connected to a first node N1. The first transistor M1 may control the amount of current flowing from the first driving power supply ELVDD to the second driving power supply ELVSS via the organic light emitting diode OLED corresponding to a voltage of the first node N1.

A first electrode of the second transistor M2 may be connected to the data line Dm, and a second electrode of the second transistor M2 may be connected to the first node N1. In addition, a gate electrode of the second transistor M2 may be connected to the scan line Sn. The second transistor M2 may be turned on to electrically connect the data line Dm and the first node N1 when the scan signal is supplied to the scan line Sn.

A first electrode of the third transistor M3 may be connected to the second electrode of the first transistor M1, and a second electrode of the third transistor M3 may be connected to the sensing line SENm. A gate electrode of the third transistor M3 may be connected to the control line CLn. The third transistor M3 may be turned on to electrically connect the sensing line SENm and the second electrode of the first transistor M1 when the scan signal is supplied to the control line CLn.

The storage capacitor Cst may be connected between the first node N1 and the second electrode of the first transistor M1. The storage capacitor Cst may store the voltage of the first node N1.

A circuit structure of the pixel 510 in the exemplary embodiment of the invention is not limited to FIG. 2A. In an exemplary embodiment of the invention, the organic light emitting diode OLED may be positioned between the first driving power supply ELVDD and the first electrode of the first transistor M1 as shown in FIG. 2B, for example. That is, in the exemplary embodiment of the invention, the circuit structure of the pixel 510 may be variously changed to include the third transistor M3 for sensing the characteristic information of the first transistor M1.

In an exemplary embodiment, although the transistors M1 to M3 are shown as an n-channel metal-oxide semiconductor ("NMOS") transistor in FIGS. 2A and 2B, the invention is not limited thereto. In another exemplary embodiment, at least one of the transistors M1 to M3 may include a p-channel metal-oxide semiconductor ("PMOS") transistor, for example.

The brightness of the pixel 510 described above may be determined by the data signal. However, a characteristic value of the first transistor M1 may be further reflected to the brightness of the pixel 510. That is, in the exemplary embodiment of the invention, the external compensation method is applied, which senses the characteristic information of the first transistor M1 during the sensing period and changes the first data Data1 by reflecting the sensed characteristic information. In such a case, a uniform quality of image may be displayed in the pixel unit 500 regardless of a characteristic deviation of the first transistor M1.

According to an exemplary embodiment, in the invention, the deviation information of the sensing lines SEN1 to SENm may be sensed and the characteristic information of the pixels 510 may be corrected by reflecting the deviation information. That is, in the exemplary embodiment of the invention, the characteristic information of the pixels 510 may be accurately sensed regardless of the deviations of the sensing lines SEN1 to SENm, thereby improving the accuracy of compensation.

According to an exemplary embodiment, a first sensing period for sensing the deviation information of the sensing lines SEN1 to SENm, and a second sensing period for sensing the characteristic information of the first transistor M1 included in each of the pixels 510 may be performed at least once before shipment of the display device. Initial characteristic information of the first transistors M1 may be stored before the shipment of the display device, and the uniform quality of images may be displayed in the pixel unit 500 by the initial characteristic information and correcting the first data Data1 (that is, generating the second data Data2).

In addition, the second sensing period may be performed every predetermined period of time even after an actual use of the display device. In an exemplary embodiment, the second sensing period may be arranged at a portion of periods of time at which the display device is turned on and/or off at every predetermined period of time, for example. Thus, although the characteristic of the driving transistor included in each of the pixels 510 changes in accordance with a usage amount, the characteristic information may be updated in real time and reflected in the generation of the data signal. Therefore, the pixel unit 500 may continuously display the uniform quality of image.

Figure 3:
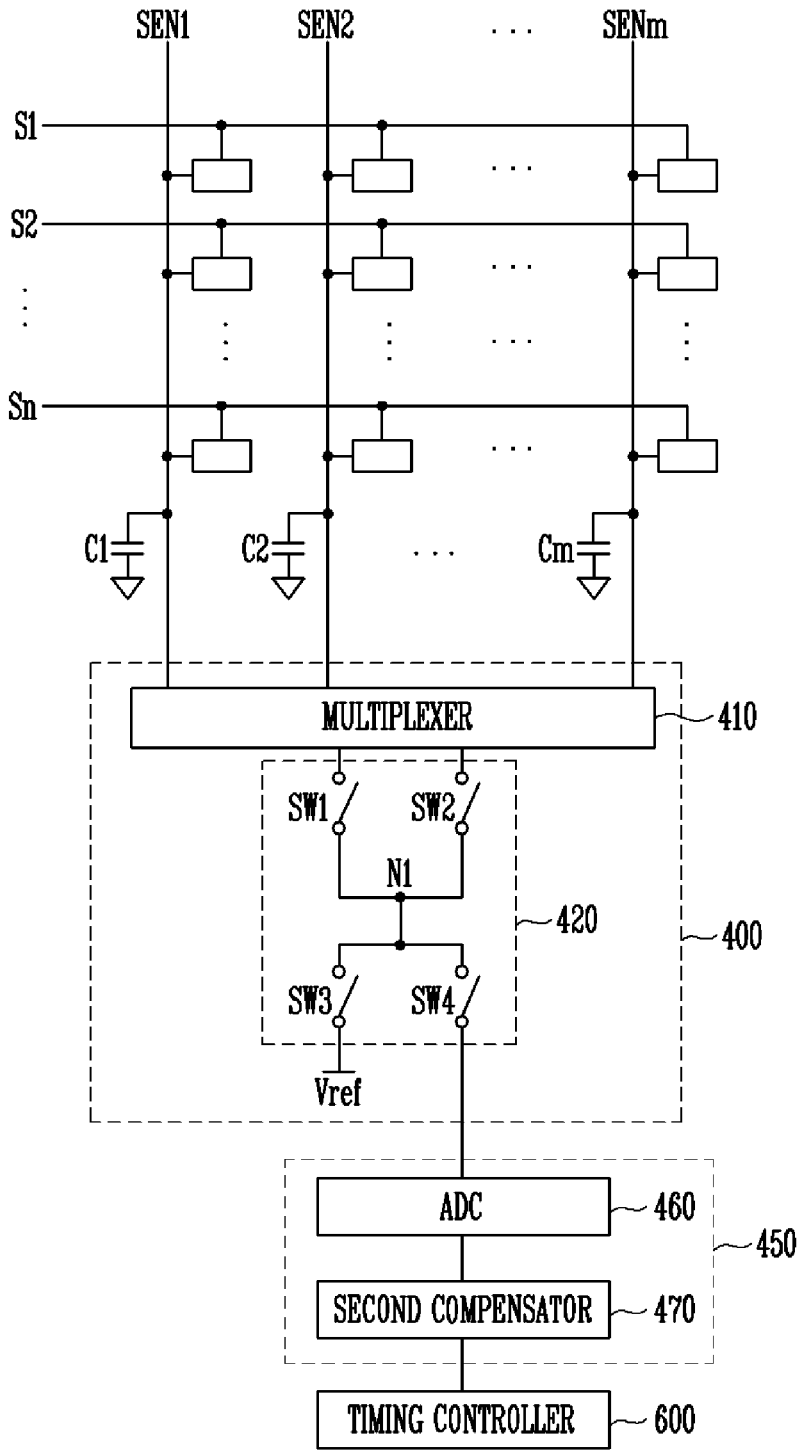
FIG. 3 is a diagram illustrating an exemplary embodiment of a first compensator and a sensing unit shown in FIG. 1.

FIG. 3 is a diagram illustrating an exemplary embodiment of the first compensator and the sensing unit shown in FIG. 1. An ADC 460 and a second compensator 470 shown in FIG. 3 may include at least one or more channels and share a plurality of channels. Capacitors C1 to Cm shown in FIG. 3 may be equivalent to parasitic capacitors of the sensing lines SEN1 to SENm, respectively.

Referring to FIG. 3, the first compensator 400 according to an exemplary embodiment of the invention may include a multiplexer 410 and a switch unit 420.

The multiplexer 410 may connect at least one of the sensing lines SEN1 to SENm to the switch unit 420. In an exemplary embodiment, the multiplexer 410 may sequentially connect two sensing lines (two of the sensing lines SEN1 to SENm) to the switch unit 420, for example. To this end, the multiplexer 410 may be determined at a ratio of m:2, for example.

The switch unit 420 may be connected to at least one of the sensing lines SEN1 to SENm via the multiplexer 410 and connect the sensing lines SEN1 to SENm connected thereto (at least one of the sensing lines SEN1 to SENm) to a reference power supply Vref or the sensing unit 450. To this end, the switch unit 420 may include a first switch SW1, a second switch SW2, a third switch SW3, and a fourth switch SW4, which are turned on or off in response to control of the timing controller 600.

The first switch SW1 may be disposed between the multiplexer 410 and the first node N1. The multiplexer 410 and the first node N1 may be electrically connected when the first switch SW1 is turned on.

The second switch SW2 may be disposed between the multiplexer 410 and the first node N1. The multiplexer 410 and the first node N1 may be electrically connected when the second switch SW2 is turned on.

The third switch SW3 may be disposed between the first node N1 and the reference power supply Vref A voltage of the reference power supply Vref may be supplied to the first node N1 when the third switch SW3 is turned on.

The fourth switch SW4 may be disposed between the first node N1 and the sensing unit 450. The first node N1 and the sensing unit 450 may be electrically connected when the fourth switch SW4 is turned on.

The sensing unit 450 may include the ADC 460 and the second compensator 470 according to an exemplary embodiment of the invention.

The ADC 460 may generate the first sensing data in a digital form by the voltage applied to each of the sensing lines SEN1 to SENm during the first sensing period. A detailed description thereof will be given below.

A predetermined voltage may be applied to the sensing lines SEN1 to SENm corresponding to the characteristic variations of the pixels 510 during the second sensing period in which the characteristic deviations of the pixels 510 are sensed. The ADC 460 may convert the voltages applied to the sensing lines SEN1 to SENm to second sensing data in a digital form and supply the second sensing data to the second compensator 470.

The second compensator 470 may store the first sensing data and the second sensing data supplied from the ADC 460. To this end, the second compensator 470 may further include a memory (not shown). The second compensator 470 may further include various configurations publicly known at the current stage and may be included in the timing controller 600.

The timing controller 600 may remove deviations between the channels (that is, the sensing lines SEN1 to SENm) in the second sensing data by the first sensing data. Thereafter, the timing controller 600 may generate the second data Data2 (refer to FIG. 1) by changing the first data Data1 (refer to FIG. 1) corresponding to the second sensing data from which the deviations between the channels are removed.

Figure 4:
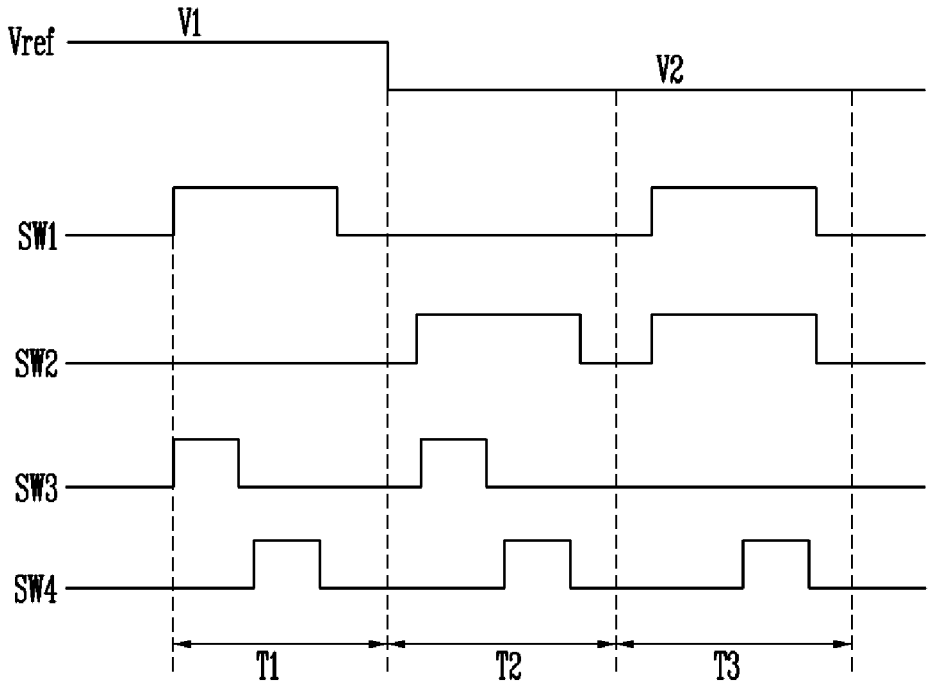
FIG. 4 is a waveform diagram illustrating an operation process of the first compensator shown in FIG. 3.

FIG. 4 is a waveform diagram illustrating an operation process of the first compensator shown in FIG. 3

Referring to FIG. 4, the multiplexer 410 may sequentially connect the first switch SW1 to a first sensing line SEN1 to an (m−1)th sensing line SENm−1. In addition, the multiplexer 410 may sequentially connect the second switch SW2 to a second sensing line SEN2 to an mth sensing line SENm. It is assumed that the first switch SW1 is connected to the first sensing line SEN1 and the second switch SW2 is connected to the second sensing line SEN2, for example.

The operation process will be described as below. The reference power supply Vref may be set to the first voltage V1 during the first period T1. The first switch SW1 may be turned on during the first period T1. In addition, the third switch SW3 and the fourth switch SW4 may be sequentially turned on during the first period T1.

The first sensing line SEN1 may be connected to the first node N1 when the first switch SW1 is turned on. The first voltage V1 of the reference power supply Vref may be supplied to the first sensing line SEN1 via the first node N1 and the first switch SW1 when the third switch SW3 is turned on. The voltage corresponding to the first voltage V1 may be stored in a first capacitor C1. The amount of charge of the first sensing line SEN1 may be represented by the following Equation 1:

$$Q1=C1\times V1 \quad \text{[Equation 1]}$$

In Equation 1, C1 denotes the first capacitor C1, V1 denotes the first voltage, and Q1 denotes the charge amount.

The third switch SW3 may be turned off and the fourth switch SW4 may be turned on. The first sensing line SEN1 may be connected to the ADC 460 via the first switch SW1, the first node N1 and the fourth switch SW4 when the fourth switch SW4 is turned on. The voltage stored in the first capacitor C1 may be supplied to the ADC 460. The ADC 460 may store the voltage stored in the first capacitor C1 to the second compensator 470 as first channel data in a digital form.

In a second period T2, the reference power supply Vref may be set to a second voltage V2 which is different from the first voltage V1. In an exemplary embodiment, the second voltage V2 may be set to a voltage lower than the first voltage V1, for example. The second switch SW2 may be turned on during the second period T2. The third switch SW3 and the fourth switch SW4 may be sequentially turned on during the second period T2.

The second sensing line SEN2 may be connected to the first node N1 when the second switch SW2 is turned on. The second voltage V2 of the reference power supply Vref may be supplied to the second sensing line SEN2 via the first node N1 and the second switch SW2 when the third switch SW3 is turned on. A voltage corresponding to the second voltage V2 may be stored in the second capacitor C2. The amount of charge of the second sensing line SEN2 may be represented by the following Equation 2:

$$Q2=C2\times V2. \quad \text{[Equation 2]}$$

In Equation 2, C2 denotes the second capacitor C2, V2 denotes the second voltage, and Q2 denotes the charge amount.

The third switch SW3 may be turned off and the fourth switch SW4 may be turned on. The second sensing line SEN2 may be connected to the ADC 460 via the second switch SW2, the first node N1, and the fourth switch SW4 when the fourth switch SW4 is turned on. The voltage stored in the second capacitor C2 may be supplied to the ADC 460. The ADC 460 may store the voltage stored in the second capacitor C2 to the second compensator 470 as second channel data in digital a form.

In a third period T3, the first switch SW1 and the second switch SW2 may be turned on. The fourth switch SW4 may be turned on so that turn-on periods of the first switch SW1 and the second switch SW2 are at least partially overlapped.

The first sensing line SEN1 and the second sensing line SEN2 may be electrically connected when the first switch SW1 and the second switch SW2 are turned on, respectively. The voltages stored in the first capacitor C1 and the second capacitor C2 may be charge-shared, so that a predetermined charge share voltage may be applied to the first sensing line SEN1 and the second sensing line SEN2. The charge share voltage may be represented by the following Equation 3:

$$C1\times V1+C2\times V2=(C1+C2)\times V\text{share}. \quad \text{[Equation 3]}$$

In Equation 3, Vshare denotes the charge share voltage.

After the first sensing line SEN1 and the second sensing line SEN2 are electrically connected, the fourth switch SW4 may be turned on. The first sensing line SEN1 and the second sensing line SEN2 may be electrically connected to the ADC 460 when the fourth switch SW4 is turned on. The charge share voltage may be supplied to the ADC 460, and the ADC 460 may store the charge share voltage as the first charge data in the second compensator 470.

When the first channel data, the second channel data, and the first charge data are used, a ratio of the first capacitor C1 to the second capacitor C2, that is, the channel deviation information may be represented by the following Equation 4:

$$C1/C2=(V\text{share}-V2)/(V1-\text{Vshare}). \quad \text{[Equation 4]}$$

The ratio of the first capacitor C1 to the second capacitor C2 may be stored in the second compensator 470 as the first sensing data.

The multiplexer 410 may sequentially connect the first switch SW1 to the second sensing line SEN2 to the (m−1)th sensing line SENm−1 and connect the second switch SW2 to a third sensing line SEN3 to the mth sensing line SENm.

In addition, each time when the first switch SW1 and the second switch SW2 are connected to the sensing lines, the deviation information of each of the sensing lines SEN1 to SENm may be sensed while repeating the first period T1 to the third period T3. In an exemplary embodiment, the ratio of the first capacitor C1 to each of the second to mth capacitors C2 to Cm (e.g., C1/C2, C1/C3 . . . C1/Cm) may be stored in the second compensator 470, for example.

The timing controller 600 may show the channel deviation information by the first sensing data, and correct the second sensing data by reflecting the channel deviation information accordingly. The second data Data2 may be generated corresponding to the characteristic information of each of the pixels 510 (refer to FIG. 1) regardless of the channel deviation, thereby improving the image quality.

Figure 5:
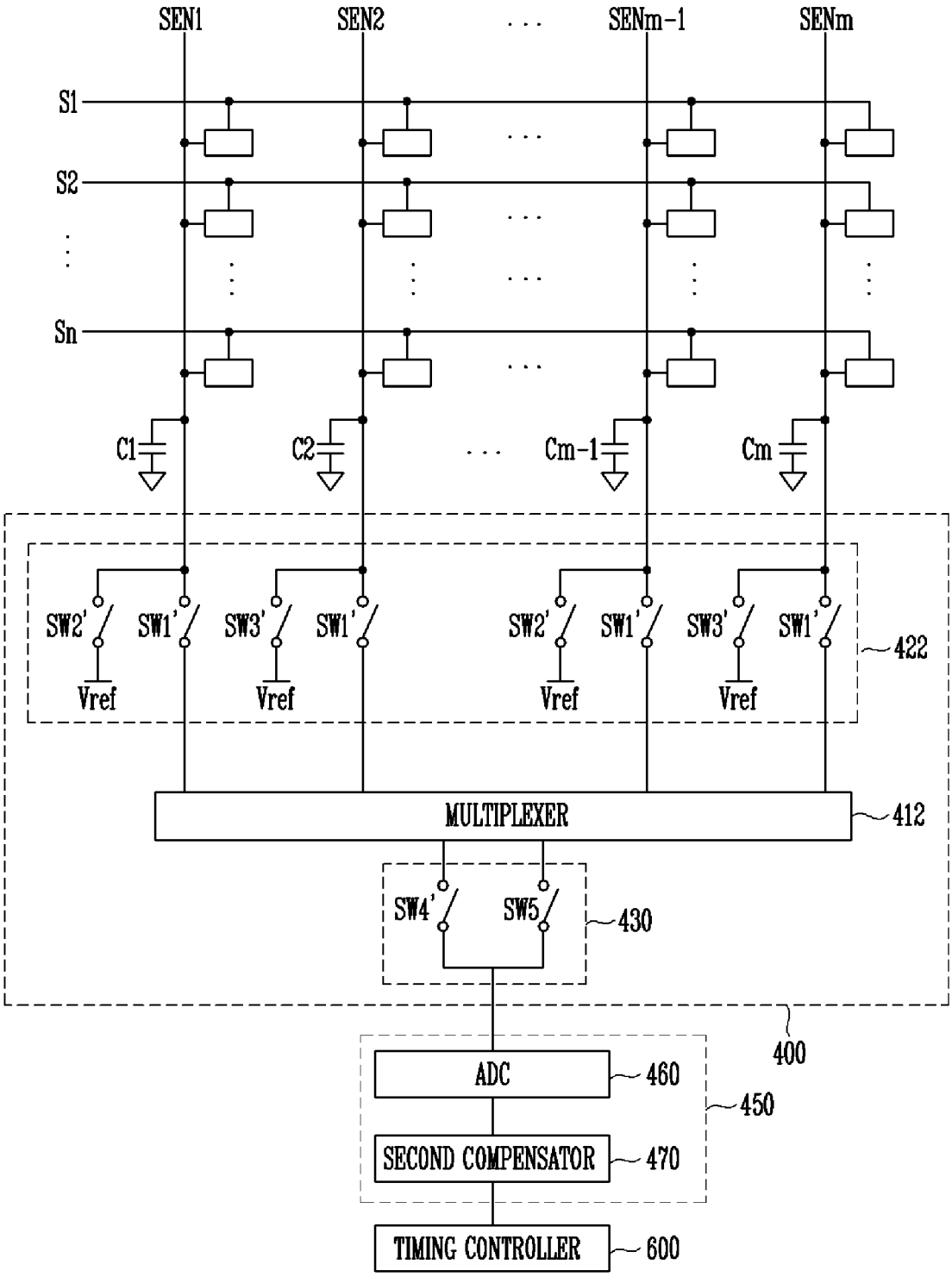
FIG. 5 is a diagram illustrating another exemplary embodiment of the first compensator shown in FIG. 1.

FIG. 5 is a diagram illustrating another exemplary embodiment of the first compensator shown in FIG. 1

Referring to FIG. 5, the first compensator 400 according to another embodiment of the invention may include a first switch unit 422, a multiplexer 412, and a second switch unit 430.

The first switch unit 422 may connect the sensing lines SEN1 to SENm to the reference power supply Vref or the multiplexer 412. To this end, the first switch unit 422 may include a first switch SW1', a second switch SW2', and a third switch SW3'.

The first switch SW1' may be disposed between each of the sensing lines SEN1 to SENm and the multiplexer 412. The sensing lines SEN1 to SENm may be connected to the multiplexer 412 when the first switch SW1' is turned on.

The second switch SW2' may be disposed between each of the odd-numbered sensing lines SEN1, SEN3, . . . , SENm−1 and the reference power supply Vref. The voltage of the reference power supply Vref may be supplied to the odd-numbered sensing lines SEN1, SEN3, . . . , SENm−1 when the second switch SW2' is turned on.

The third switch SW3' may be disposed between each of the even-numbered sensing lines SEN2, SEN4, . . . , SENm and the reference power supply Vref. The voltage of the reference power supply Vref may be supplied to the even-numbered sensing lines SEN2, SEN4, . . . , SENm when the third switch SW3' is turned on.

The multiplexer 412 may connect at least one of the sensing lines SEN 1 to SENm to the second switch unit 430 via the first switch unit 422. In an exemplary embodiment, the even-numbered sensing lines SEN2, SEN4, . . . , SENm may be sequentially connected to a fifth switch SW5, for example. In addition, the multiplexer 412 may sequentially connect at least a portion of the odd-numbered sensing lines SEN1, SEN3, . . . , SENm−1 to a fourth switch SW4'. A detailed description thereof will be described below in connection with the waveform view.

The second switch unit 430 may be connected between the multiplexer 412 and the ADC 460. The second switch unit 430 may include a fourth switch SW4' and the fifth switch SW5.

The fourth switch SW4' may sequentially connect at least a portion of the odd-numbered sensing lines SEN1, SEN3, . . . , SENm−1 to the ADC 460 via the multiplexer 412.

The fifth switch SW5 may sequentially connect the even-numbered sensing lines SEN2, SEN4, . . . , SENm to the ADC 460 via the multiplexer 412.

Figure 6:
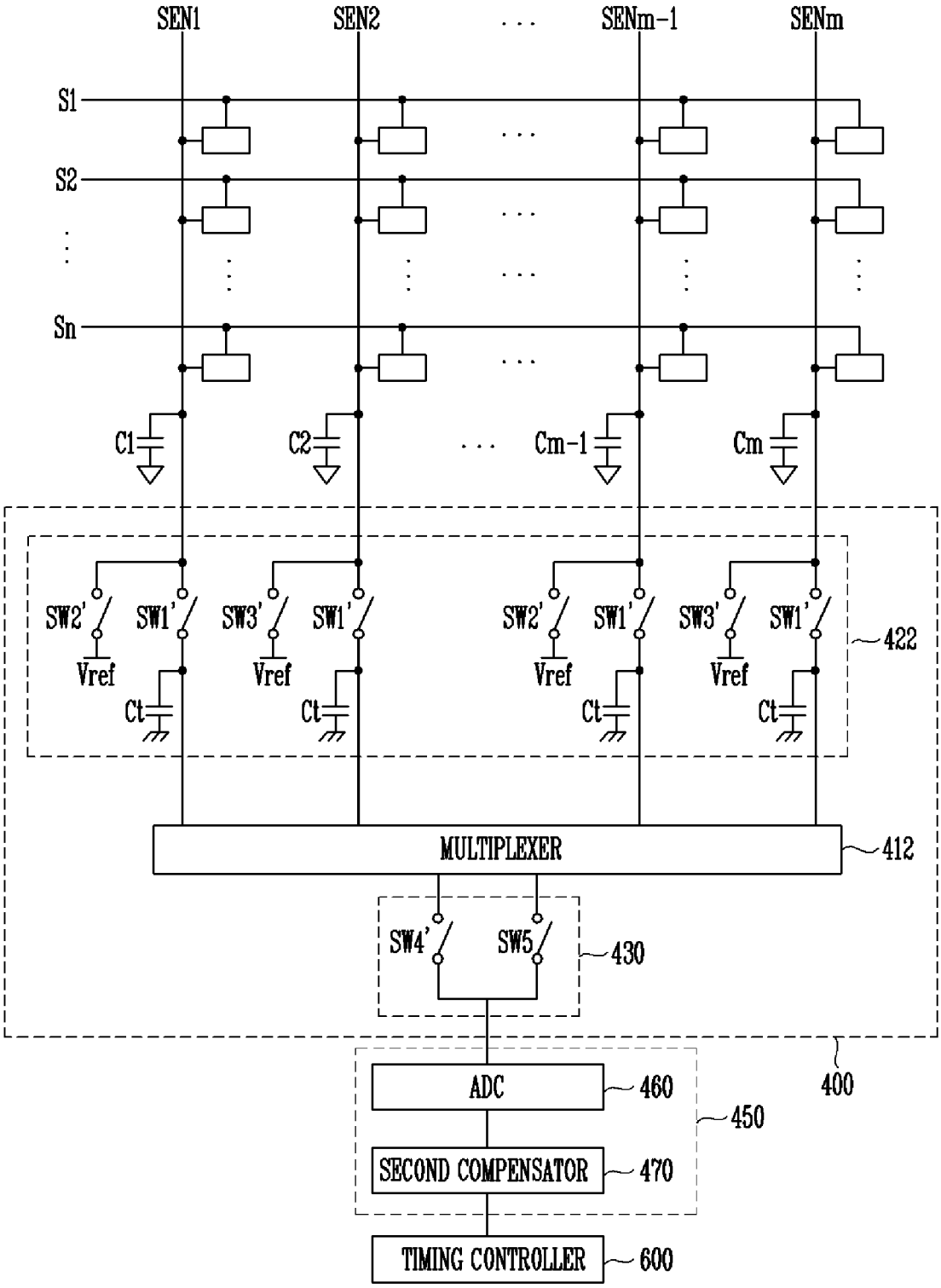
FIG. 6 is a diagram illustrating another exemplary embodiment of the first compensator shown in FIG. 5.

In the exemplary embodiment of the invention, as shown in FIG. 6, an auxiliary capacitor Ct, which is disposed between the first switch SW1' and the multiplexer 412 and connected between each of the first switches SW1' and a ground power supply may be additionally provided. The auxiliary capacitor Ct may store a voltage supplied from the first switch SW1'.

Figure 7:
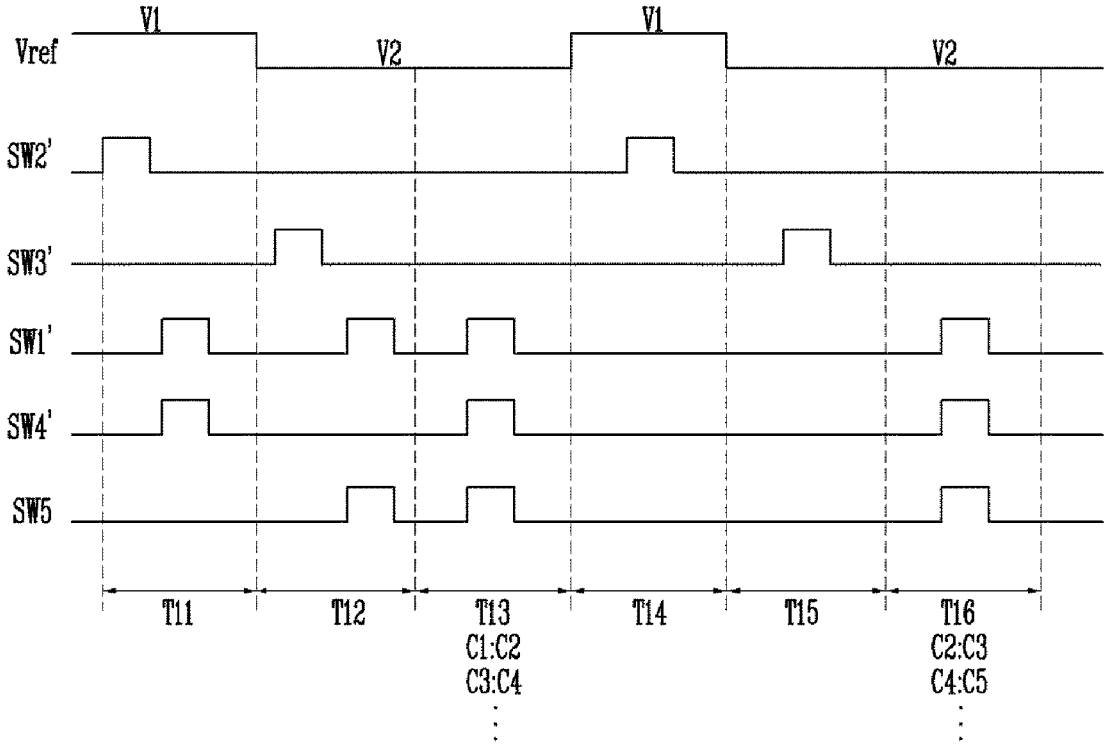
FIG. 7 is a waveform diagram illustrating an operation process of the first compensator shown in FIG. 5.

FIG. 7 is a waveform diagram illustrating an operation process of the first compensator shown in FIG. 5.

Referring to FIG. 7, the reference power supply Vref may be set to the first voltage V1 during a first period T11. The second switch SW2' may be turned on during the first period T1. The first voltage V1 of the reference power supply Vref may be supplied to the odd-numbered sensing lines SEN1, SEN3, . . . , SENm−1 when the second switch SW2' is turned on. The first voltage V1 may be stored in the capacitors C1, C3, . . . , Cm−1 equivalently positioned in the odd-numbered sensing lines SEN1, SEN3, . . . , SENm−1, respectively.

After the first voltage V1 is stored in the capacitors C1, C3, . . . , Cm−1 disposed in the odd sensing lines SEN1, SEN3, . . . , SENm−1, the first switch SW1' and the fourth switch SW4' may be turned on.

Each of the odd-numbered sensing lines SEN1, SEN3, . . . , SENm−1 may be connected to the multiplexer 412 when the first switch SW1' is turned on. The ADC 460 may be connected to the multiplexer 412 when the fourth switch SW4' is turned on.

The multiplexer 412 may sequentially connect the odd-numbered sensing lines SEN1, SEN3, . . . , SENm−1 to the fourth switch SW4'. In an exemplary embodiment, the multiplexer 412 may sequentially connect the fourth switch SW4' to the first sensing line SEN1, the third sensing line SEN3, . . . , and the (m−1)th sensing line SENm−1, for example. The voltages stored in the capacitors C1, C3, . . . , Cm−1 of the odd-numbered sensing lines SEN1, SEN3, . . . , SENm−1 may be supplied to the ADC 460. The ADC 460 may store the voltages stored in the capacitors C1, C3, . . . , Cm−1 in the second compensator 470 as odd-numbered channel data in a digital form.

In the second period T12, the reference power supply Vref may be set to the second voltage V2 which is different from the first voltage V1. In an exemplary embodiment, the second voltage V2 may be set to the voltage lower than the first voltage V1, for example. In the second period T12, the third switch SW3' may be turned on. The second voltage V2 of the reference power supply Vref may be supplied to the even-numbered sensing lines SEN2, SEN4, . . . , SENm when the third switch SW3' is turned on. The second voltage V2 may be stored in the capacitors C2, C4, . . . , Cm equivalently positioned in the even-numbered sensing lines SEN2, SEN4, . . . , SENm, respectively.

After the second voltages V2 are stored in the capacitors C2, C4, . . . , Cm disposed in the even-numbered sensing lines SEN2, SEN4, . . . , SENm, the first switch SW1' and the fifth switch SW5 may be turned on.

Each of the even-numbered sensing lines SEN2, SEN4, . . . , SENm may be connected to the multiplexer 412 when the first switch SW1' is turned on. The ADC 460 may be connected to the multiplexer 412 when the fifth switch SW5 is turned on.

The multiplexer 412 may sequentially connect the even-numbered sensing lines SEN2, SEN4, . . . , SENm to the fifth switch SW5. In an exemplary embodiment, the multiplexer 412 may sequentially connect the fifth switch SW5 to the second sensing line SEN2, the fourth sensing line SEN4, . . . , and the mth sensing line SENm. The voltages stored in the capacitors C2, C4, . . . , Cm of the even-numbered sensing lines SEN2, SEN4, . . . , SENm may be supplied to the ADC 460, for example. The ADC 460 may store the voltages stored in the capacitors C2, C4, . . . , Cm in the second compensator 470 as even-numbered channel data in a digital form.

According to an exemplary embodiment, channel data of each of the sensing lines SEN1 to SENm may be stored in the second compensator 470 according to the first period T11 and a second period T12 described above.

The first switch SW1', the fourth switch SW4', and the fifth switch SW5 may be turned on during a third period T13. The sensing lines SEN1 to SENm may be connected to the multiplexer 412 when the first switch SW1' is turned on. The ADC 460 may be connected to the multiplexer 412 when the fourth switch SW4' and the fifth switch SW5 are turned on.

During the third period T13, the multiplexer 412 may electrically connect adjacent sensing lines. In an exemplary embodiment, during the third period T13, the multiplexer 412 may electrically connect a predetermined sensing line to a sensing line, which is disposed on the left side on the basis of the predetermined sensing line, for example.

In an exemplary embodiment, the multiplexer 412 may connect the fourth switch SW4' to the first sensing line SEN1, the third sensing line SEN3, . . . , the (m−1)th sensing line SENm−1 during the third period T13, for example. The multiplexer 412 may connect the fifth switch SW5 to the second sensing line SEN2, the fourth sensing line SEN4, . . . , and the mth sensing line SENm during the third period T13.

When the first sensing line SEN1 is connected to the fourth switch SW4' and the second sensing line SEN2 is connected to the fifth switch SW5, the voltages stored in the first capacitor C1 and the second capacitor C2 may be charge-shared. In such a case, the predetermined charge share voltage may be applied to the first sensing line SEN1 and the second sensing line SEN2.

The charge sharing voltage of the first sensing line SEN1 and the second sensing line SEN2 may be supplied to the ADC 460. The ADC 460 may store the charge sharing voltage in the second compensator 470 as the first charge data.

As described above, the multiplexer 412 may sequentially connect the fourth switch SW4' to the first sensing line SEN1, the third sensing line SEN3, . . . , the (m−1)th sensing line SENm−1 and sequentially connect the fifth switch SW5 to the second sensing line SEN2, the fourth sensing line SEN4, . . . , the mth sensing line SENm during the third period T13. Correspondingly, the ADC 460 may generate and store third charge data (corresponding to the third sensing line SEN3 and a fourth sensing line SEN4), fifth charge data (corresponding to a fifth sensing line SEN5 and a sixth sensing line SEN6), . . . , and the like in the second compensator 470 during the third period T13.

In a fourth period T14, the reference power supply Vref may be set to the first voltage V1, and the second switch SW2' may be turned on. The first voltage V1 of the reference power supply Vref may be supplied to the odd-numbered sensing lines SEN1, SEN3, . . . , and SENm−1 when the second switch SW2' is turned on. The first voltage V1 may be stored in the capacitors C1, C3, . . . , Cm−1 disposed in the odd-numbered sensing lines SEN1, SEN3, SENm−1, respectively.

In a fifth period T15, the reference power supply Vref may be set to the second voltage V2, and the third switch SW3' may be turned on. The second voltage V2 of the reference power supply Vref may be supplied to the even-numbered sensing lines SEN2, SEN4, . . . , SENm when the third switch SW3' is turned on. The second voltage V2 may be stored in the capacitors C2, C4, . . . , Cm disposed in the even-numbered sensing lines SEN2, SEN4, . . . , SENm, respectively.

In a sixth period T16, the first switch SW1', the fourth switch SW4', and the fifth switch SW5 may be turned on. The sensing lines SEN1 to SENm may be connected to the multiplexer 412 when the first switch SW1' is turned on. The ADC 460 may be connected to the multiplexer 412 when the fourth switch SW4' and the fifth switch SW5 are turned on.

During a sixth period T16, the multiplexer 412 may electrically connect the adjacent sensing lines. In an exemplary embodiment, during the third period T13, the multiplexer 412 may electrically connect a predetermined sensing line with a sensing line positioned on the right side on the basis of the predetermined sensing line, for example.

In an exemplary embodiment, the multiplexer 412 may sequentially connect the fourth switch SW4' to the third sensing line SEN3, the fifth sensing line SEN5, . . . , to the (m−1)th sensing line SENm−1 during the sixth period T16, for example. The multiplexer 412 may sequentially connect the fifth switch SW5 to the second sensing line SEN2, the fourth sensing line SEN4, . . . , an (m−2)th sensing line SENm−2 during the sixth period T16.

When the third sensing line SEN3 is connected to the fourth switch SW4' and the second sensing line SEN2 is connected to the fifth switch SW5, the voltages stored in the second capacitor C2 and the third capacitor C3 may be charge-shared. In such a case, a predetermined charge share voltage may be applied to the second sensing line SEN2 and the third sensing line SEN3.

The charge share voltage of the second sensing line SEN2 and the third sensing line SEN3 may be supplied to the ADC 460. The ADC 460 may store the charge share voltage in the second compensator 470 as the second charge data.

As described above, the multiplexer 412 may sequentially connect the fourth switch SW4' to the third sensing line SEN3, the fifth sensing line SEN5, . . . , the (m−1)th sensing line SENm−1 during the sixth period T16, and connect the fifth switch SW5 to the second sensing line SEN2, the fourth sensing line SEN4, . . . , the (m−2)th sensing line SENm−2. Correspondingly, the ADC 460 may generate and store second charge data (corresponding to the second sensing line SEN2 and the third sensing line SEN3), fourth charge data (corresponding to the fourth sensing line SEN4 and the fifth sensing line SEN5), and the like in the second compensator 470 during the sixth period T16.

The channel data and the charge data of each of the sensing lines SEN1 to SENm may be sensed through the first period T11 to the sixth period T16. The second compensator 470 or the timing controller 600 may obtain ratios of capacitors of each channel by the channel data and the charge data. In an exemplary embodiment, the second compensator 470 or the timing controller 600 may determine a ratio of the first capacitor C1 to each of the second to mth capacitors C2 to Cm (e.g., C1/C2, C1/C3 . . . C1/Cm), for example. Information on a ratio of the capacitors obtained in the second compensator 470 or the timing controller 600, that is, the deviation information of the sensing lines SEN1 to SENm may be stored in the second compensator 470 as the first sensing data.

The timing controller 600 may show the channel deviation information by the first sensing data and correct the second sensing data by reflecting the channel deviation information. The second data Data2 may be generated corresponding to the characteristic information of each of the pixels 510 (refer to FIG. 1) regardless of the channel deviation, thereby improving the image quality.

Figure 8:
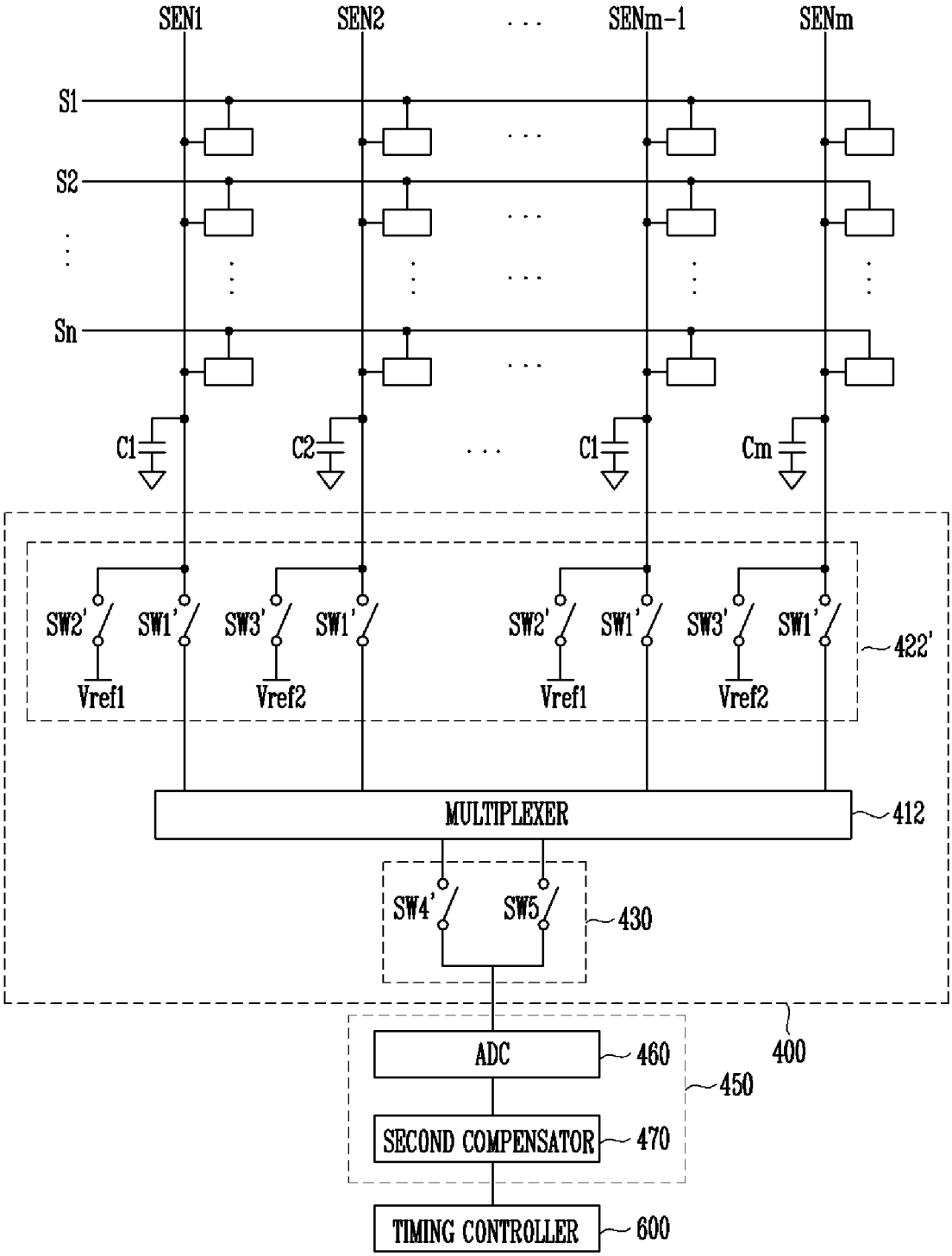
FIG. 8 is a diagram illustrating another exemplary embodiment of the first compensator shown in FIG. 1.

FIG. 8 is a diagram illustrating another embodiment of the first compensator shown in FIG. 1. The same reference numerals are assigned to the same constituent elements as those in FIG. 5, and a detailed description thereof will be omitted.

Referring to FIG. 8, the first compensator 400 according to another embodiment of the invention may include a first switch unit 422', the multiplexer 412, and a second switch 430.

The first switch unit 422' may connect the odd-numbered sensing lines SEN1, SEN3, . . . , SENm−1 to a first reference power supply Vref1 or the multiplexer 412. In addition, the first switch unit 422' may connect the even-numbered sensing lines SEN2, SEN4, . . . , SENm to a second reference power supply Vref2 or the multiplexer 412. To this end, the first switch unit 422' may include the first switch SW1', the second switch SW2', and the third switch SW3'.

The first switch SW1' may be positioned between each of the sensing lines SEN1 to SENm and the multiplexer 412. The sensing lines SEN1 to SENm may be connected to the multiplexer 412 when the first switch SW1' is turned on.

The second switch SW2' may be disposed between each of the odd-numbered sensing lines SEN1, SEN3, . . . , SENm−1 and the first reference power supply Vref1. The first reference power supply Vref1 may be set to the first voltage V1. The first voltage V1 of the first reference power supply Vref1 may be supplied to the odd-numbered sensing lines SEN1, SEN3, . . . , SENm−1 when the second switch SW2' is turned on.

The third switch SW3' may be disposed between each of the even-numbered sensing lines SEN2, SEN4, . . . , SENm and the second reference power supply Vref2. The second reference power supply Vref2 may be set to the second voltage V2. The second voltage V2 of the second reference power supply Vref2 may be supplied to the even-numbered sensing lines SEN2, SEN4, . . . , SENm when the third switch SW3' is turned on.

Figure 9:
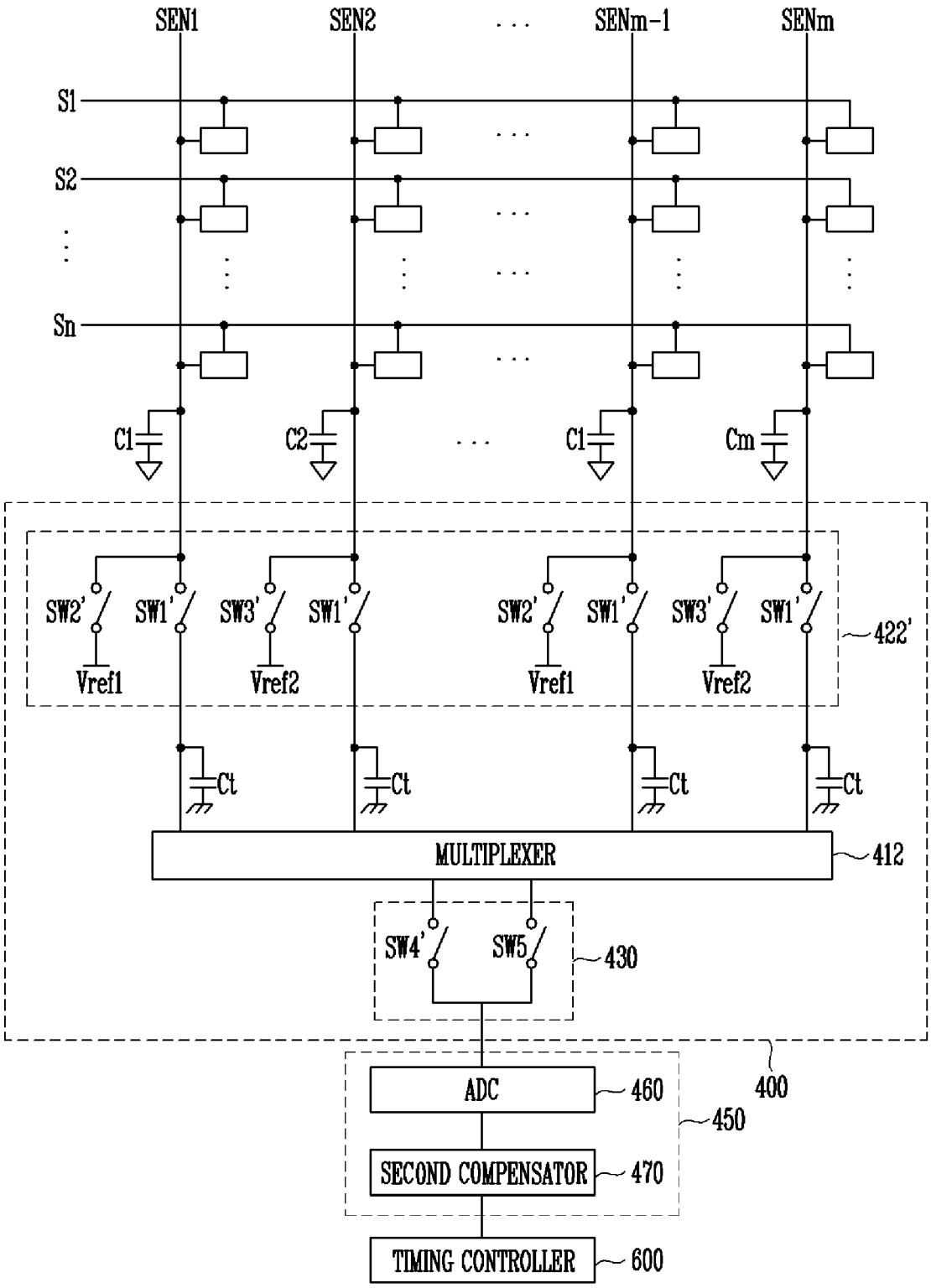
FIG. 9 is a diagram illustrating another exemplary embodiment of the first compensator shown in FIG. 8.

According to an exemplary embodiment, as shown in FIG. 9, an auxiliary capacitor Ct, which is disposed between the first switch SW1' and the multiplexer 412 and connected to each of the first switches SW1', may be additionally provided. The auxiliary capacitor Ct may store a voltage supplied from the first switch SW1'.

Figure 10:
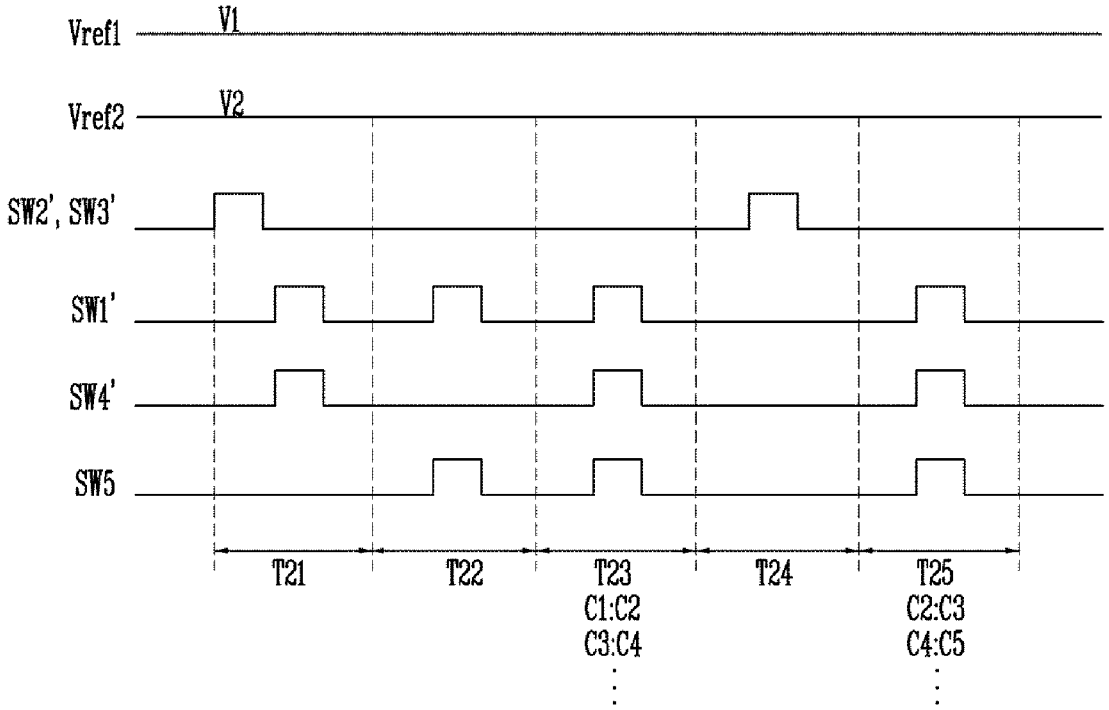
FIG. 10 is a waveform diagram illustrating an operation process of the first compensator shown in FIG. 8.

FIG. 10 is a waveform diagram illustrating an operation process of the first compensator shown in FIG. 8.

Referring to FIG. 10, the second switch SW2' and the third switch SW3' may be turned on during a first period T21.

The first voltage V1 of the first reference power supply Vref1 may be supplied to the odd-numbered sensing lines SEN1, SEN3, . . . , SENm−1 when the second switch SW2' is turned on. The first voltage V1 may be stored in the capacitors C1, C3, . . . , Cm−1 equivalently positioned in the odd-numbered sensing lines SEN1, SEN3, . . . , SENm−1, respectively.

The second voltage V2 of the second reference power supply Vref2 may be supplied to the even-numbered sensing lines SEN2, SEN4, . . . , SENm when the third switch SW3' is turned on. The second voltage V2 may be stored in the capacitors C2, C4, . . . , Cm equivalently positioned in each of the even-numbered sensing lines SEN2, SEN4, . . . , SENm, respectively.

The first switch SW1' and the fourth switch SW4' may be turned on during the first period T21. Each of the sensing lines SEN1 to SENm may be connected to the multiplexer 412 when the first switch SW1' is turned on. The ADC 460 may be connected to the multiplexer 412 when the fourth switch SW4' is turned on.

The multiplexer 412 may sequentially connect the odd-numbered sensing lines SEN1, SEN3, . . . , SENm−1 to the fourth switch SW4'. In an exemplary embodiment, the multiplexer 412 may sequentially connect the fourth switch SW4' to the first sensing line SEN1, the third sensing line SEN3, . . . , the (m−1)th sensing line SENm−1, for example. The voltages stored in the capacitors C1, C3, . . . , Cm−1 of the odd-numbered sensing lines SEN1, SEN3, . . . , SENm−1, respectively, may be supplied to the ADC 460. The ADC 460 may store the voltages stored in the capacitors C1, C3, . . . , Cm−1 in the second compensator 470 as the odd-numbered channel data in a digital form.

In a second period T22, the first switch SW1' and the fifth switch SW5 may be turned on.

Each of the sensing lines SEN1 to SENm may be connected to the multiplexer 412 when the first switch SW1' is turned on. The ADC 460 may be connected to the multiplexer 412 when the fifth switch SW5 is turned on.

The multiplexer 412 may sequentially connect the even-numbered sensing lines SEN2, SEN4, . . . , SENm to the fifth switch SW5. In an exemplary embodiment, the multiplexer 412 may sequentially connect the fifth switch SW5 to the second sensing line SEN2, the fourth sensing line SEN4, . . . , the mth sensing line SENm, for example. The voltages stored in the capacitors C2, C4, . . . , Cm of the even-numbered sensing lines SEN2, SEN4, . . . , SENm, respectively, may be supplied to the ADC 460, for example. The ADC 460 may store the voltages stored in the capacitors C2, C4, . . . , Cm in the second compensator 470 as the even-numbered channel data in a digital form.

According to an exemplary embodiment, the channel data of each of the sensing lines SEN1 to SENm may be stored in the second compensator 470 by the first period T21 and the second period T22 described above.

Subsequently, the first switch SW1', the fourth switch SW4' and the fifth switch SW5 may be turned on during a third period T23. The sensing lines SEN1 to SENm may be connected to the multiplexer 412 when the first switch SW1' is turned on. The ADC 460 may be connected to the multiplexer 412 when the fourth switch SW4' and the fifth switch SW5 are turned on.

During the third period T23, the multiplexer 412 may electrically connect the adjacent sensing lines. In an exemplary embodiment, during the third period T23, the multiplexer 412 may electrically connect the predetermined sensing line to the sensing line, which is disposed on the left side on the basis of the predetermined sensing line, for example.

In an exemplary embodiment, the multiplexer 412 may connect the fourth switch SW4' to the first sensing line SEN1, the third sensing line SEN3, . . . , the (m−1)th sensing line SENm−1 during the third period T23, for example. In addition, the multiplexer 412 may sequentially connect the fifth switch SW5 to the second sensing line SEN2, the fourth sensing line SEN4, . . . , the mth sensing line SENm during the third period T23.

When the first sensing line SEN1 is connected to the fourth switch SW4' and the second sensing line SEN2 is connected to the fifth switch SW5, the voltages stored in the first capacitor C1 and the second capacitor C2 may be charge-shared. In such a case, a predetermined charge share voltage may be applied to the first sensing line SEN1 and the second sensing line SEN2.

The charge share voltages of the first sensing line SEN1 and the second sensing line SEN2 may be supplied to the ADC 460. The ADC 460 may output the charge share voltage in the second compensator 470 as the first charge data.

Thus, the multiplexer 412 may sequentially contact the fourth switch SW4' to the first sensing line SEN1, the third sensing line SEN3, . . . , the (m−1)th sensing line SENm−1 and sequentially connect the fifth switch SW5 to the second sensing line SEN2, the fourth sensing line SEN4, . . . , the mth sensing line SENm during the third period T23. Correspondingly, the ADC 460 may generate and store third charge data (corresponding to the third sensing line SEN3 and the fourth sensing line SEN4), fifth charge data (corresponding to the fifth sensing line SEN5 and the sixth sensing line SEN6), and the like in the second compensator 470 during the third period T23.

In a fourth period T24, the second switch SW2' and the third switch SW3' may be turned on. The first voltage V1 of the first reference power supply Vref1 may be supplied to the odd-numbered sensing lines SEN1, SEN3, . . . , SENm−1 when the second switch SW2' is turned on. The first voltage V1 may be stored in the capacitors C1, C3, . . . , Cm−1 disposed in the odd-numbered sensing lines SEN1, SEN3, . . . , SENm−1, respectively.

The second voltage V2 of the second reference power supply Vref2 may be supplied to the even-numbered sensing lines SEN2, SEN4, . . . , SENm when the third switch SW3' is turned on. The second voltage V2 may be stored in the capacitors C2, C4, . . . , Cm disposed in the even-numbered sensing lines SEN2, SEN4, . . . , SENm, respectively.

In a fifth period T25, the first switch SW1', the fourth switch SW4', and the fifth switch SW5 may be turned on. The sensing lines SEN1 to SENm may be connected to the multiplexer 412 when the first switch SW1' is turned on. The ADC 460 may be connected to the multiplexer 412 when the fourth switch SW4' and the fifth switch SW5 are turned on.

During the fifth period T25, the multiplexer 412 may electrically connect the adjacent sensing lines. In an exemplary embodiment, during the fifth period T25, the multiplexer 412 may electrically connect the predetermined sensing line and the sensing line disposed on the right side on the basis of the predetermined sensing line, for example.

In an exemplary embodiment, the multiplexer 412 may sequentially connect the fourth switch SW4' to the third sensing line SEN3, the fifth sensing line SEN5, . . . , the (m−1)th sensing line SENm−1 during the fifth period T25, for example. The multiplexer 412 may connect the fifth switch SW5 to the second sensing line SEN2, the fourth sensing line SEN4, . . . , the (m−2)th sensing line SENm−2 during the fifth period T25.

When the third sensing line SEN3 is connected to the fourth switch SW4' and the second sensing line SEN2 is connected to the fifth switch SW5, the voltages stored in the second capacitor C2 and the third capacitor C3 may be charge-shared. In such a case, a predetermined charge share voltage may be applied to the second sensing line SEN2 and the third sensing line SEN3.

The charge share voltages of the second sensing line SEN2 and the third sensing line SEN3 may be supplied to the ADC 460. The ADC 460 may store the charge share voltage in the second compensator 470 as the second charge data.

As described above, the multiplexer 412 may sequentially connect the fourth switch SW4' to the third sensing line SEN3, the fifth sensing line SEN5, . . . , the (m−1)th sensing line SENm−1 and sequentially connect the fifth switch SW5 to the second sensing line SEN2, the fourth sensing line SEN4, . . . , the (m−2)th sensing line SENm−2 during the fifth period T25. Correspondingly, the ADC 460 may generate the second charge data (corresponding to the second sensing line SEN2 and the third sensing line SEN3), the fourth charge data (corresponding to the fourth sensing line SEN4 and the fifth sensing line SEN5), and the like in the second compensator 470 during the fifth period T25.

The channel data and the charge data of the sensing lines SEN1 to SENm may be sensed through the first period T21 to the fifth period T25 as described above. The second compensator 470 or the timing controller 600 may obtain the ratio of the capacitors of each channel by the channel data and the charge data. In an exemplary embodiment, the second compensator 470 or the timing controller 600 may obtain the ratios of the first capacitors C1 and the second to mth capacitors C2 to Cm, for example. The information on the ratios of the capacitors obtained in the second compensator 470 or the timing controller 600, that is, the deviation information of the sensing lines SEN1 to SENm may be stored in the second compensator 470 as the first sensing data.

The timing controller 600 may show the channel deviation information by the first sensing data and correct the second sensing data by reflecting the channel deviation information. The second data Data2 may be generated corresponding to the characteristic information of each of the pixels 510 (refer to FIG. 1) regardless of the channel deviation, thereby improving the image quality.

Figure 11:
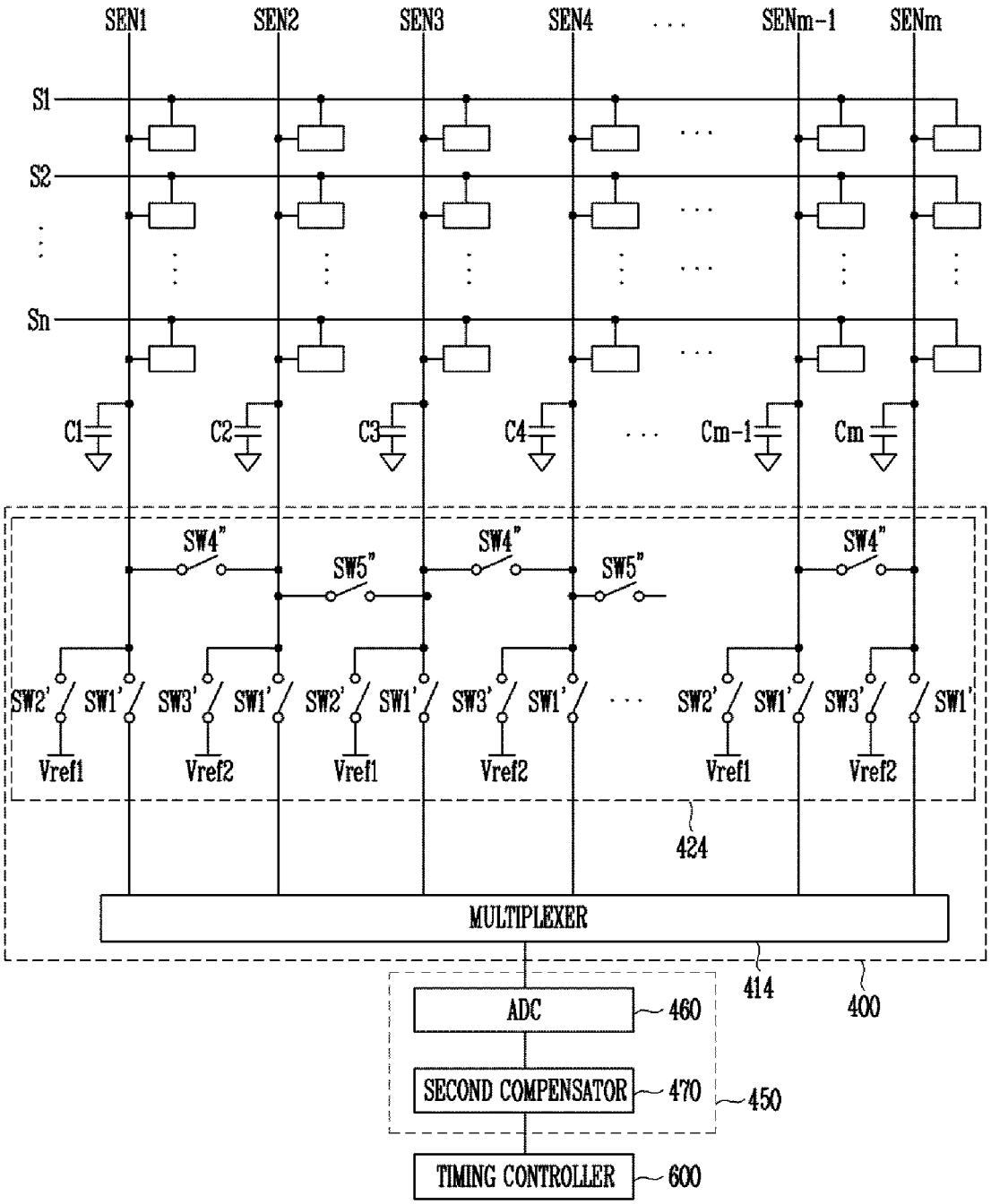
FIG. 11 is a diagram illustrating another exemplary embodiment of the first compensator shown in FIG. 1.

FIG. 11 is a diagram illustrating another exemplary embodiment of the first compensator shown in FIG. 1.

Referring to FIG. 11, the first compensator 400 according to another embodiment of the invention may include a switch unit 424 and a multiplexer 414.

The switch unit 424 may connect the sensing lines SEN1, SEN3, . . . , SENm to the multiplexer 414, the first reference power supply Vref1 or the second reference power supply Vref2. The switch unit 424 may include the first switches SW1', the second switches SW2', the third switches SW3', fourth switches SW4" and fifth switches SW5".

The first switches SW1' may be disposed between the sensing lines SEN1 to SENm and the multiplexer 414. The sensing lines SEN1 to SENm may be connected to the multiplexer 414 when the first switches SW1' are turned on.

The second switches SW2' may be disposed between the odd-numbered sensing lines SEN1, SEN3, . . . , SENm−1 and the first reference power supplies Vref1. The first reference power supplies Vref1 may be set to the first voltages V1. The first voltages V1 of the first reference power supplies Vref1 may be supplied to the odd-numbered sensing lines SEN1, SEN3, . . . , SENm−1 when the second switches SW2' are turned on.

The third switches SW3' may be disposed between the even-numbered sensing lines SEN2, SEN4, . . . , SENm and the second reference power supplies Vref2. The second reference power supplies Vref2 may be set to the second voltages V2. The second voltages V2 of the second reference power supplies Vref2 may be supplied to the even-numbered sensing lines SEN2, SEN4, . . . , SENm when the third switches SW3' are turned on.

The fourth switches SW4" may be disposed between an ith sensing line SENi (where i is 1, 3, 5, 7, . . . ) and an (i+1)th sensing line SENi+1. The ith sensing line SENi and the (i+1)th sensing line SENi+1 may be electrically connected when the fourth switches SW4" are turned on.

The fifth switches SW5" may be disposed between the (i+1)th sensing line SENi+1 and an (i+2)th sensing line SENi+2. The (i+1)th sensing line SENi+1 and the (i+2)th sensing line SENi+2 may be electrically connected when the fifth switches SW5" are turned on.

The multiplexer 414 may control connection of the sensing lines SEN1 to SENm and the ADC 460. In an exemplary embodiment, the multiplexer 414 may sequentially connect the sensing lines SEN1 to SENm to the ADC 460, for example.

Figure 12:
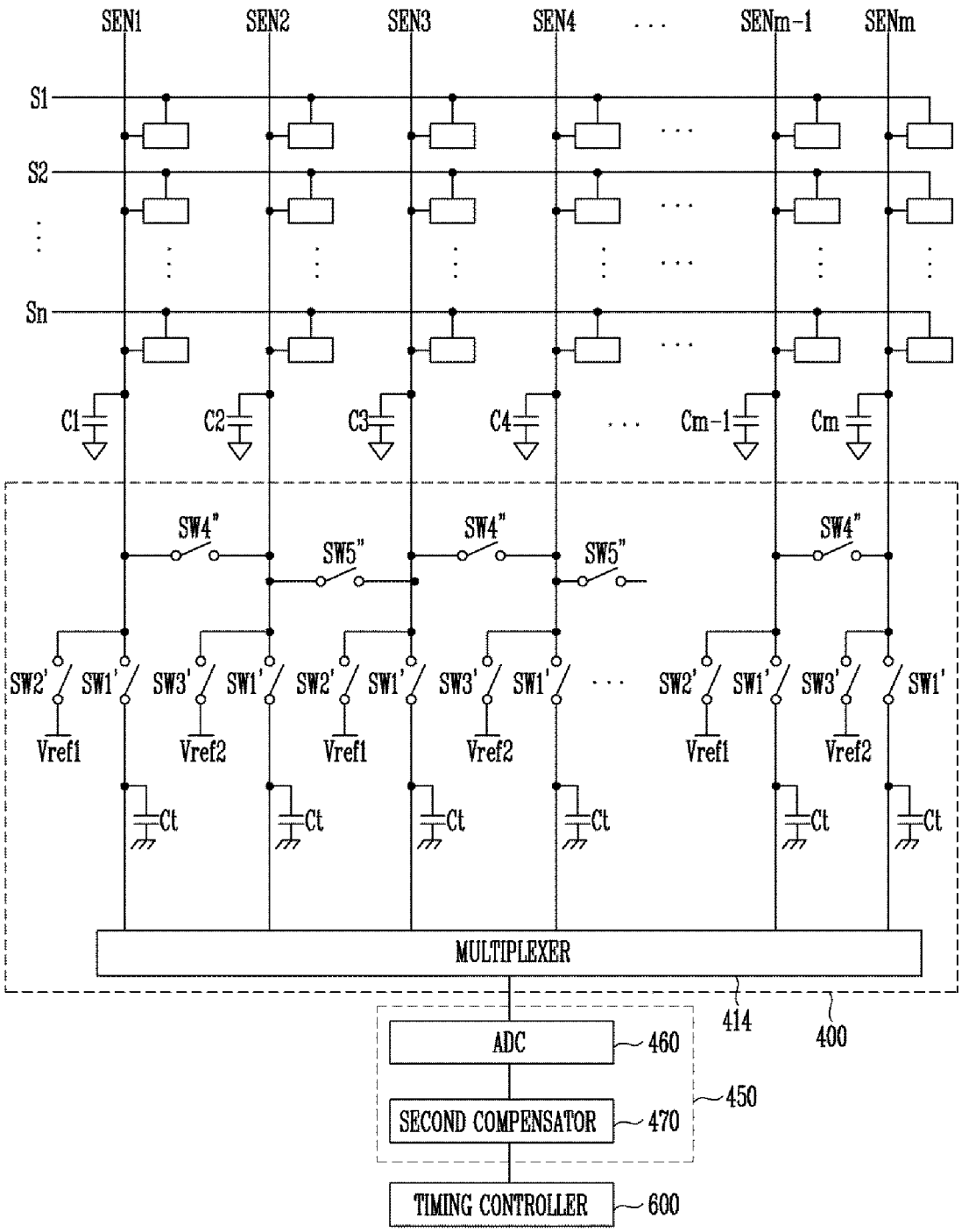
FIG. 12 is a diagram illustrating another exemplary embodiment of the first compensator shown in FIG. 11.

In the exemplary embodiment of the invention, as shown in FIG. 12, the auxiliary capacitor Ct, which is disposed between the first switch SW1' and the multiplexer 414 and connected to each of the first switches SW1', may be additionally provided. The auxiliary capacitor Ct may store a voltage supplied from the first switch SW1'.

Figure 13:
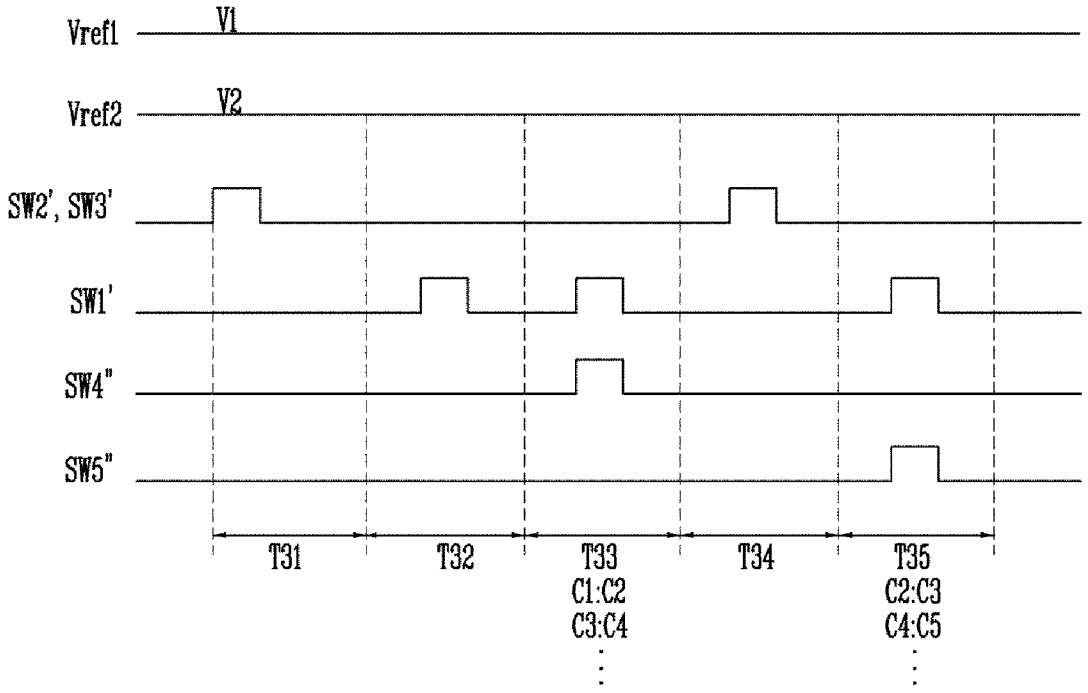
FIG. 13 is a diagram illustrating an operation process of the first compensator shown in FIG. 11.

FIG. 13 is a diagram illustrating an operation process of the first compensator shown in FIG. 11.

Referring to FIG. 13, the second switch SW2' and the third switch SW3' may be turned on during a first period T31.

The first voltage V1 of the first reference power supply Vref1 may be supplied to the odd-numbered sensing lines SEN1, SEN3, . . . , SENm−1 when the second switch SW2' is turned on. The first voltage V1 may be stored in the capacitors C1, C3, . . . , Cm−1 equivalently positioned in the odd-numbered sensing lines SEN1, SEN3, . . . , SENm−1, respectively.

The second voltage V2 of the second reference power supply Vref2 may be supplied to the even-numbered sensing lines SEN2, SEN4, . . . , SENm when the third switch SW3' is turned on. The second voltage V2 may be stored in the capacitors C2, C4, . . . , Cm equivalently positioned in the even-numbered sensing lines SEN2, SEN4, . . . , SENm, respectively.

In a second period T32, the first switch SW1' may be turned on. The sensing lines SEN1 to SENm may be connected to the multiplexer 414 when the first switch SW1' is turned on.

The multiplexer 414 may sequentially connect the sensing lines SEN1 to SENm to the ADC 460. The voltages stored in the capacitors C1 to Cm of the sensing lines SEN1 to SENm, respectively, may be supplied to the ADC 460. The ADC 460 may store the voltages stored in the capacitors C1 to Cm in the second compensator 470 as the channel data in a digital form.

In a third period T33, the first switch SW1' and the fourth switch SW4" may be turned on. The ith sensing line SENi and the (i+1)th sensing line SENi+1 may be electrically connected when the fourth switch SW4" is turned on. In such a case, a predetermined charge share voltage may be applied to the ith sensing line SENi and the (i+1)th sensing line SENi+1.

The multiplexer 414 may be sequentially connected to the ith sensing line SENi or the (i+1)th sensing line SENi+1 during the third period T33. Then, the ADC 460 may generate the first charge data (corresponding to the first sensing line SEN1 and the second sensing line SEN2), the third charge data (corresponding to the third sensing line SEN3 and the fourth sensing line SEN4), the fifth charge data (corresponding to the fifth sensing line SEN5 and the sixth sensing line SEN6), and the like, and the generated charge data may be stored in the second compensator 470.

During a fourth period T34, the second switch SW2' and the third switch SW3' may be turned on. The first voltage V1 of the first reference power supply Vref1 may be supplied to the odd-numbered sensing lines SEN1, SEN3, . . . , SENm−1 when the second switch SW2' is turned on. The first voltage V1 may be stored in the capacitors C1, C3, . . . , Cm−1 disposed in the odd-numbered sensing lines SEN1, SEN3, . . . , SENm−1, respectively.

The second voltage V2 of the second reference power supply Vref2 may be supplied to the even-numbered sensing lines SEN2, SEN4, . . . , SENm when the third switch SW3' is turned on. The second voltage V2 may be stored in the capacitors C2, C4, . . . , Cm disposed in the even-numbered sensing lines SEN2, SEN4, . . . , SENm, respectively.

In a fifth period T35, the first switch SW1' and the fifth switch SW5" may be turned on. The (i+1)th sensing line SENi+1 and the (i+2)th sensing line SENi+1 may be electrically connected when the fifth switch SW5" is turned on. In such a case, a predetermined charge share voltage may be applied to the (i+1)th sensing line SENi+1 and the (i+2)th sensing line SENi+2.

The multiplexer 414 may be sequentially connected to the (i+1)th sensing line SENi+1 or the (i+2)th sensing line SENi+2 during the fifth period T35. The ADC 460 may generate the second charge data (corresponding to the second sensing line SEN2 and the third sensing line SEN3), the fourth charge data (corresponding to the fourth sensing line SEN4 and the fifth sensing line SEN5) and the like, and the generated charge data may be supplied to the second compensator.

The channel data and the charge data of the sensing lines SEN1 to SENm may be sensed through the first period T31 to the fifth period T35 as described above. The second compensator 470 or the timing controller 600 may obtain the ratio of the capacitors of each channel by the channel data and the charge data. In an exemplary embodiment, the second compensator 470 or the timing controller 600 may obtain the ratio of the second capacitor C2 to the mth capacitor Cm based on the first capacitor C1, for example. The information on the ratio of the capacitors obtained in the second compensator 470 or the timing controller 600, that is, the deviation information of the sensing lines SEN1 to SENm may be stored in the second compensator 470 as first sensing data.

The timing controller 600 may show the channel deviation information by the first sensing data and correct the second sensing data by reflecting the channel deviation information. The second data Data2 may be generated corresponding to the characteristic information of each of the pixels 510 (refer to FIG. 1) regardless of the channel deviation, thereby improving the image quality.

Figure 14:
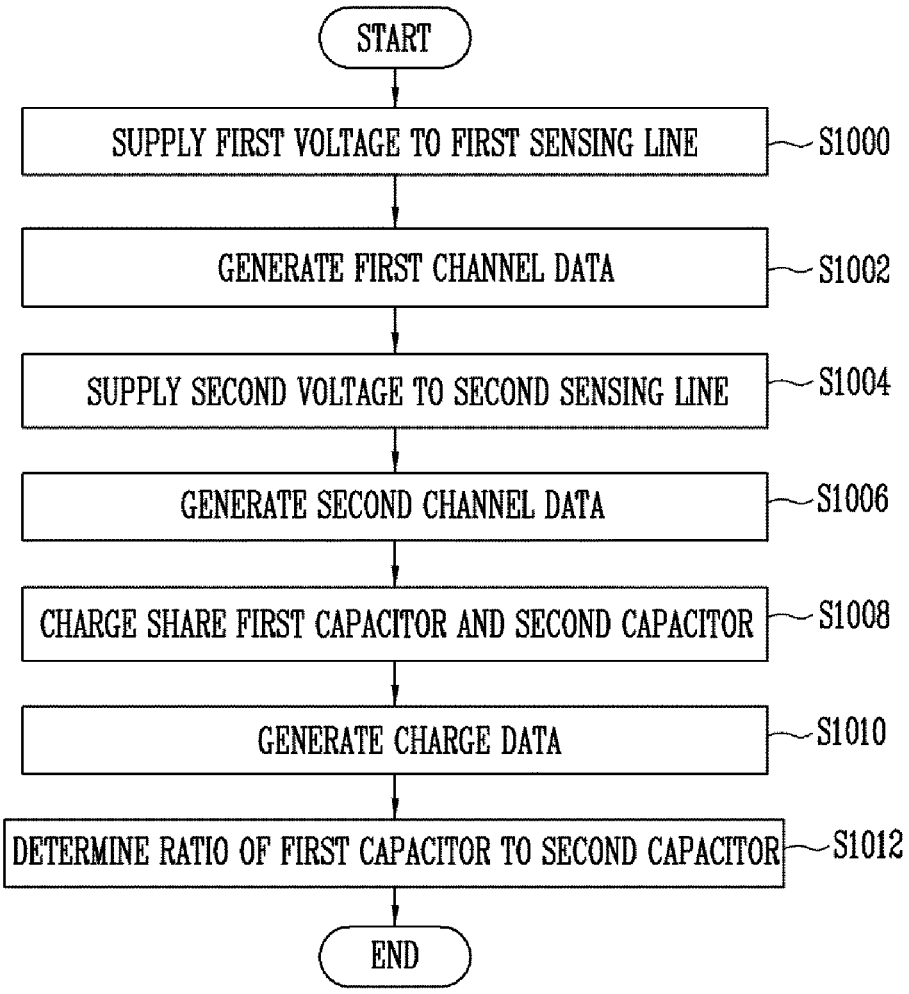
FIG. 14 is a diagram illustrating an exemplary embodiment of a driving method for sensing channel deviation information according to the invention.

FIG. 14 is a diagram illustrating a driving method for sensing channel deviation information according to an exemplary embodiment. FIG. 14 discloses a principle of a driving method of the invention by two sensing lines.

Referring to FIG. 14, the first voltage V1 may be supplied to the first sensing line (S1000). A voltage corresponding to the first voltage V1 may be applied to the first capacitor equivalent to the first sensing line. The ADC 460 may generate the first channel data in a digital form by the voltage stored in the first capacitor (S1002).

After the first channel data is generated, the second voltage V2 different from the first voltage V1 may be supplied to the second sensing line (S1004). A voltage corresponding to the second voltage V2 may be stored in the second capacitor equivalent to the second sensing line. The ADC 460 may generate the second channel data in a digital form by the voltage stored in the second capacitor (S1006).

FIG. 14 shows that the second voltage is supplied to the second sensing line after the first channel data is generated. However, the invention is not limited thereto. In an exemplary embodiment, the first channel data may be generated after the second voltage V2 is supplied to the second sensing, for example.

After the second channel data is generated in operation S1006, the first sensing line and the second sensing line may be electrically connected. The voltage stored in the first capacitor and the voltage stored in the second capacitor may be charge-shared, and a predetermined charge share voltage may be applied to the first sensing line and the second sensing line (S1008).

Subsequently, the ADC 460 may generate charge data in a digital form by the charge share voltage (S1010). The timing controller 600 or the second compensator 470 may determine or obtain the ratio of the first capacitor to the second capacitor by the first channel data, the second channel data, and the charge data (S1012). The deviation information of the first sensing line and the second sensing line may be used as the ratio of the first capacitor to the second capacitor.

According to a display device and a driving method thereof according to the exemplary embodiment of the invention, first sensing data corresponding to channel deviation information and second sensing data corresponding to characteristic information of pixels may be sensed. The channel deviation may be removed from the second sensing data by the first sensing data, and thus the characteristic deviation of the pixels may be accurately compensated.

While the invention has been particularly shown and described with reference to exemplary embodiments thereof, it is to be understood that the invention is not limited to the disclosed exemplary embodiments. It will be apparent to those skilled in the art that various modifications may be made without departing from the scope of the invention.

The scope of the invention is defined by the following claims, and is not limited to the description of the specification, and all variations and modifications falling within the scope of the claims are included in the scope of the invention.

What is claimed is:

1. A display device, comprising:

pixels connected to data lines and scan lines;

a first compensator which is connected to sensing lines and senses deviation information of the sensing lines while supplying different voltages having different amplitudes from each other to adjacent sensing lines of the sensing lines respectively when the different voltages are simultaneously applied; and a sensing unit which is connected to the first compensator and senses characteristic information of each of the pixels.

2. The display device of claim 1, wherein the first compensator supplies a first voltage to a first capacitor provided in a predetermined sensing line of the adjacent sensing lines and supplies a second voltage different from the first voltage to a second capacitor provided in an adjacent sensing line of the adjacent sensing lines.

3. The display device of claim 2, wherein the sensing unit generates first channel data in a digital form by a voltage stored in the first capacitor and generates second channel data in a digital form by a voltage stored in the second capacitor.

4. The display device of claim 3, wherein the sensing unit generates charge data in a digital form by a charge share voltage generated by charge-sharing the first capacitor and the second capacitor.

5. The display device of claim 4, further comprising a timing controller which obtains a ratio of the first capacitor to the second capacitor by the first channel data, the second channel data, and the charge data, wherein the ratio of the first capacitor to the second capacitor is the deviation information.

6. The display device of claim 1, wherein the first compensator includes a multiplexer connected to the sensing lines and a switch unit connected between the multiplexer and the sensing unit.

7. The display device of claim 6, wherein the switch unit includes a first switch connected between the multiplexer and a first node, a second switch connected between the multiplexer and the first node, a third switch connected between the first node and a reference power supply, and a fourth switch connected between the first node and the sensing unit.

8. The display device of claim 7, wherein the multiplexer sequentially connects the first switch to a first sensing line to an (m−1)th sensing line of the sensing lines where m is a natural number greater than two, and sequentially connects the second switch to a second sensing line to an mth sensing line of the sensing lines.

9. The display device of claim 7, wherein the third switch is turned on to supply a first voltage of the reference power supply to a predetermined sensing line of the adjacent sensing lines connected to the first switch during at least a portion of a period in which the first switch is turned on, and the third switch is turned on to supply a second voltage of the reference power supply to an adjacent sensing line of the adjacent sensing lines connected to the second switch during at least a portion of a period in which the second switch is turned on.

10. The display device of claim 9, wherein the first voltage and the second voltage are set to be different from each other.

11. The display device of claim 9, wherein the first voltage is set to be higher than the second voltage.

12. The display device of claim 9, wherein after the first voltage is stored in a first capacitor equivalently provided in the predetermined sensing line, and the second voltage is stored in a second capacitor equivalently provided in the adjacent sensing line, the first switch and the second switch are turned on, and voltages respectively stored in the first capacitor and the second capacitor are charge-shared.

13. The display device of claim 12, wherein a ratio of the first capacitor to the second capacitor is the deviation information.

14. The display device of claim 1, wherein the first compensator comprises:

a first switch unit connected to the sensing lines;

a multiplexer connected to the first switch; and a second switch unit connected between the multiplexer and the sensing unit.

15. The display device of claim 14, wherein the first switch unit includes first switches connected between the sensing lines and the multiplexer, second switches connected between odd-numbered sensing lines of the sensing lines and a reference power supply, and third switches connected between even-numbered sensing lines and the reference power supply.

16. The display device of claim 15, wherein the reference power supply is set to a first voltage when the second switches are turned on, and the reference power supply is set to a second voltage different from the first voltage when the third switches are turned on.

17. The display device of claim 16, the second switches and the third switches are turned on at different times from each other.

18. The display device of claim 15, further comprising an auxiliary capacitor disposed between a first switch of the first switches and the multiplexer and connected between the first switch and a ground power supply.

19. The display device of claim 15, wherein the second switch unit includes a fourth switch connected between the multiplexer and the sensing unit, and a fifth switch connected between the multiplexer and the sensing unit.

20. The display device of claim 19, wherein the multiplexer sequentially connects the fourth switch to the odd numbered sensing lines, and the multiplexer sequentially connects the fifth switch to the even numbered sensing lines.

21. The display device of claim 14, wherein the first switch unit includes first switches connected between the sensing lines and the multiplexer, second switches connected between odd-numbered sensing lines of the sensing lines and a first reference power supply, and third switches connected between even numbered sensing lines of the sensing lines and a second reference power supply.

22. The display device of claim 21, wherein the first reference power supply is set to a first voltage, and the second reference power supply is set to a second voltage different from the first voltage.

23. The display device of claim 21, wherein the second switches and the third switches are concurrently turned on and turned off.

24. The display device of claim 1, wherein the first compensator includes a switch unit connected to the sensing lines, and a multiplexer connected between the switch unit and the sensing unit.

25. The display device of claim 24, wherein the switch unit comprises:

first switches connected between the sensing lines and the multiplexer;

second switches connected between odd numbered sensing lines of the sensing lines and a first reference power supply;

third switches connected between even numbered sensing lines of the sensing lines and a second reference power supply;

fourth switches connected between an ith sensing line and an (i+1)th sensing line, where i is an odd number equal to and greater than 1; and fifth switches connected between the (i+1)th sensing line and an (i+2)th sensing line.

26. The display device of claim 25, wherein the first reference power supply is set to a first voltage and the second reference power supply is set to a second voltage different from the first voltage.

27. The display device of claim 25, wherein the second switches and the third switches are concurrently turned on.

28. The display device of claim 25, wherein the fourth switches and the first switches are turned on after a voltage of the first reference power supply is stored in the odd numbered sensing lines and a voltage of the second reference power supply is stored in the even numbered sensing lines, and the fifth switches and the first switches are turned on after the voltage of the first reference power supply is stored in the odd numbered sensing lines and the voltage of the second reference power supply is stored in the even numbered sensing lines.

29. The display device of claim 25, further comprising an auxiliary capacitor disposed between a first switch of the first switches and the multiplexer and connected between the first switch and a ground power supply.

30. The display device of claim 1, further comprising a timing controller which removes a deviation of the sensing lines from the characteristic information of each of the pixels by the deviation information.

31. The display device of claim 30, further comprising:

a scan driver which supplies scan signals to the scan lines; and a data driver which generates data signals by second data and supplies the data signals to the data lines, wherein the timing controller generates the second data by first data supplied from an external source corresponding to the characteristic information from which the deviation is removed.

32. The display device of claim 1, wherein the sensing lines are the data lines.

33. The display device of claim 1, wherein the sensing unit comprises:

an analog-to-digital converter which converts the deviation information into first sensing data in a digital form and converts the characteristic information into second sensing data in a digital form; and a second compensator in which the first sensing data and the second sensing data are stored.

34. The display device of claim 1, each of the different voltages is constant.

* * * * *